US007054736B2

(12) United States Patent
Son

(10) Patent No.: US 7,054,736 B2
(45) Date of Patent: May 30, 2006

(54) METHOD FOR COMPUTING THE QUANTITY OF INJECTED FUEL FOR AN AUTOMOBILE ENGINE EQUIPPED WITH AN ELECTRICALLY CONTROLLED FUEL INJECTION SYSTEM AND AN APPARATUS FOR DETECTING AN EXCHANGE PERIOD FOR LUBRICATING OILS AND CONSTITUTIONAL PARTS

(76) Inventor: Sil Kyu Son, Hwangie Villa A - 301, 894-19, Daeyeon-Dong, Nam-gu, Pusan (KR)

( * ) Notice: Subject to any disclaimer, the term of this patent is extended or adjusted under 35 U.S.C. 154(b) by 0 days.

(21) Appl. No.: 10/993,959

(22) Filed: Nov. 19, 2004

(65) Prior Publication Data

US 2005/0113993 A1 May 26, 2005

(30) Foreign Application Priority Data

Nov. 20, 2003 (KR) ..... 10-2003-0082442

(51) Int. Cl.
*G01M 15/04* (2006.01)

(52) U.S. Cl. ..... 701/114; 701/30; 701/123; 73/113; 340/457.4

(58) Field of Classification Search ..... None

See application file for complete search history.

(56) References Cited

U.S. PATENT DOCUMENTS 4,400,779 A * 8/1983 Kosuge et al. ..... 701/123
5,642,284 A * 6/1997 Parupalli et al. ..... 701/30
6,453,731 B1 * 9/2002 Yaegashi ..... 73/113
6,513,368 B1 * 2/2003 Bondarowicz et al. ..... 701/30

FOREIGN PATENT DOCUMENTS

JP 2002-250213 A * 9/2005

* cited by examiner

*Primary Examiner*—Andrew M. Dolinar
(74) *Attorney, Agent, or Firm*—Jordan and Hamburg LLP

(57) ABSTRACT

A method for computing the quantity of injected fuel for an automobile engine equipped with an electronically controlled fuel injection system and an apparatus for detecting an exchange period for lubricating oils and constitutional parts are capable of informing a driver of an exchange period for an engine oil per use of a proper fuel quantity by calculating a total of the accumulated quantity of injected fuel for the automobile engine equipped with the electronically controlled fuel injection system. The method and apparatus are also capable of informing the driver of the exchange period for various lubricating oils and constitutional parts in accordance with the number of exchange of the engine oil and of allowing-the driver to exchange various lubricating oils and constitutional parts on a basis of accurate information under in an optimum condition. The method and apparatus also prevent the driver from being confused and extend the life span of the automobile engine.

5 Claims, 12 Drawing Sheets

【Fig 1a】
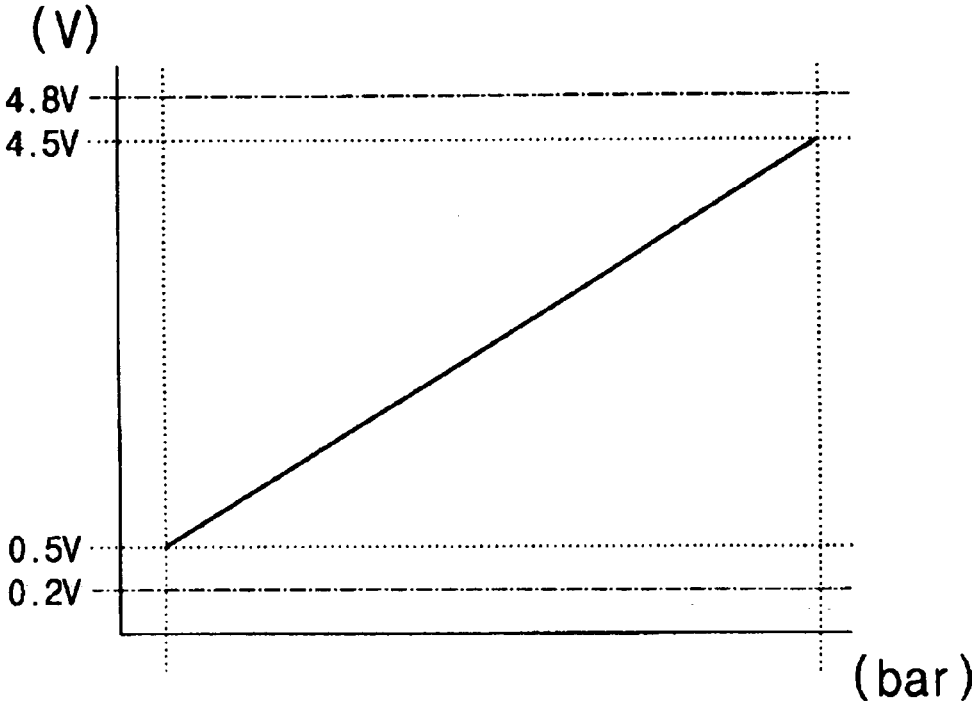
【Fig 1b】
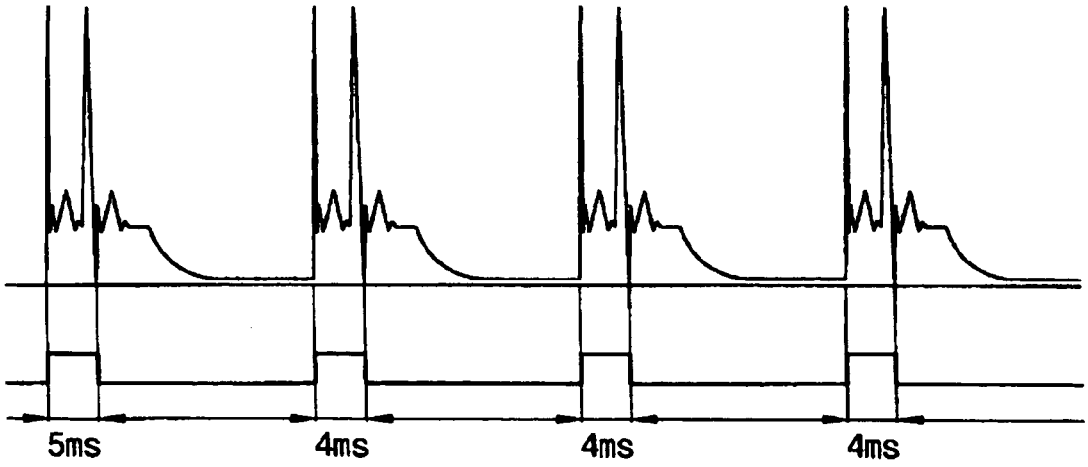

【Fig 1c】
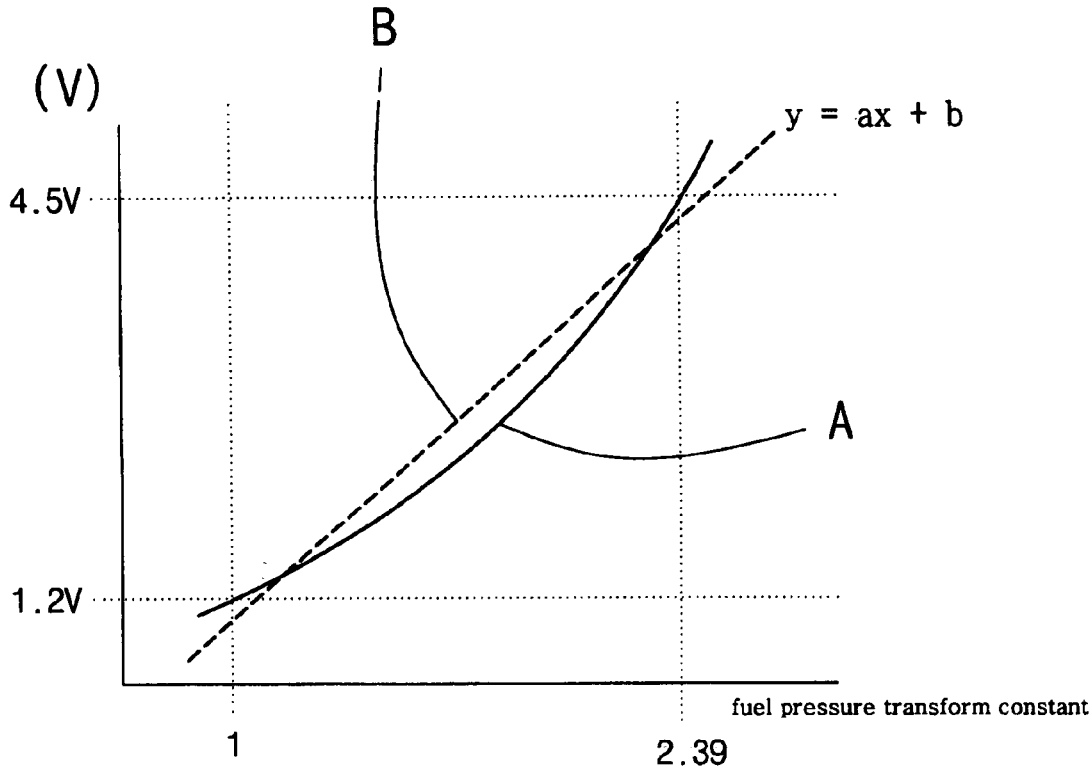
【fig 2】
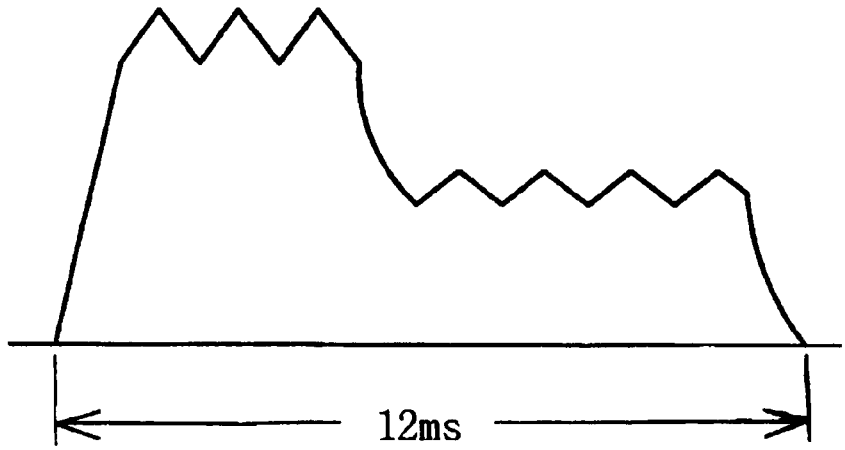

[Fig 3]
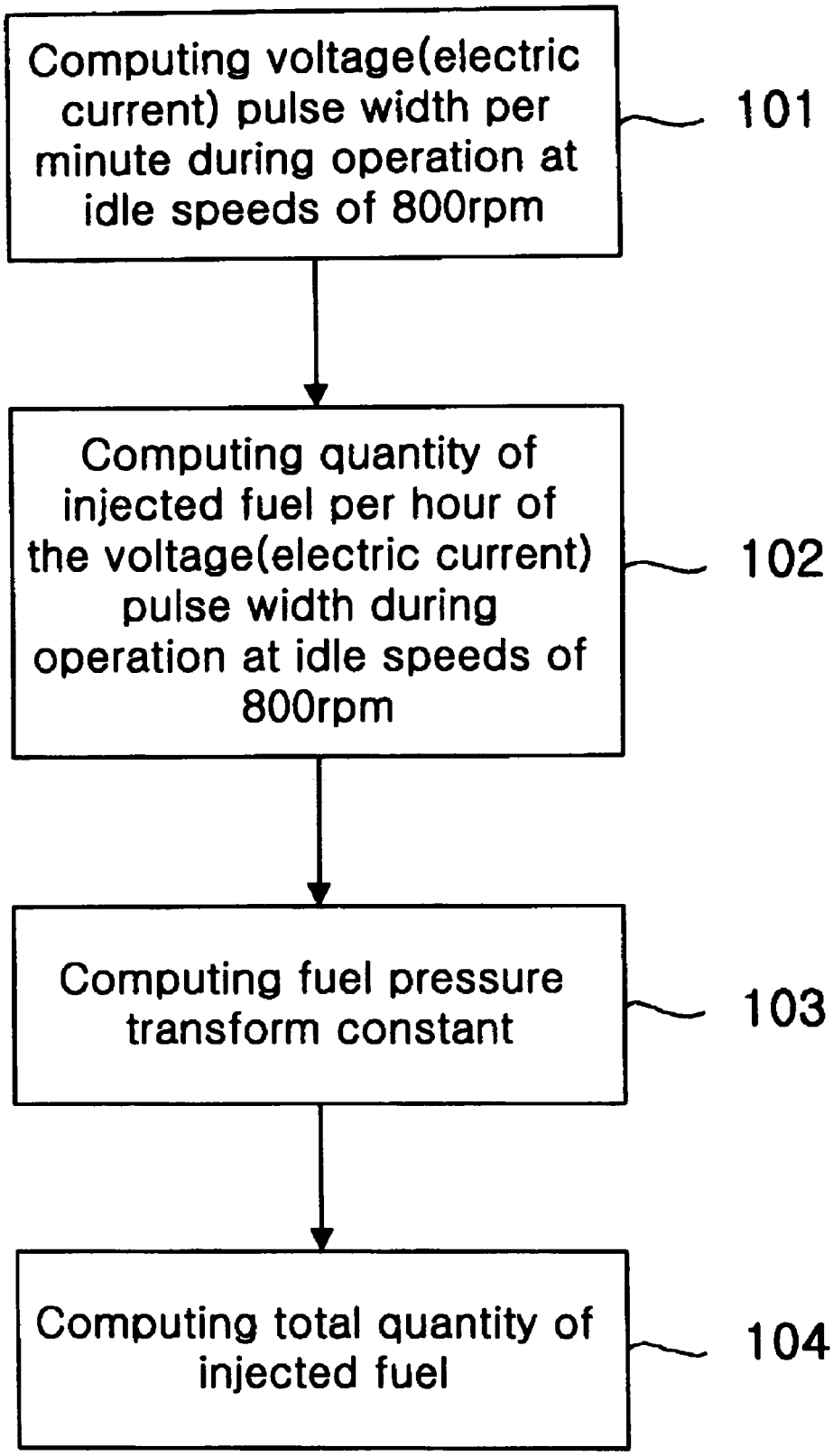

【Fig 4】
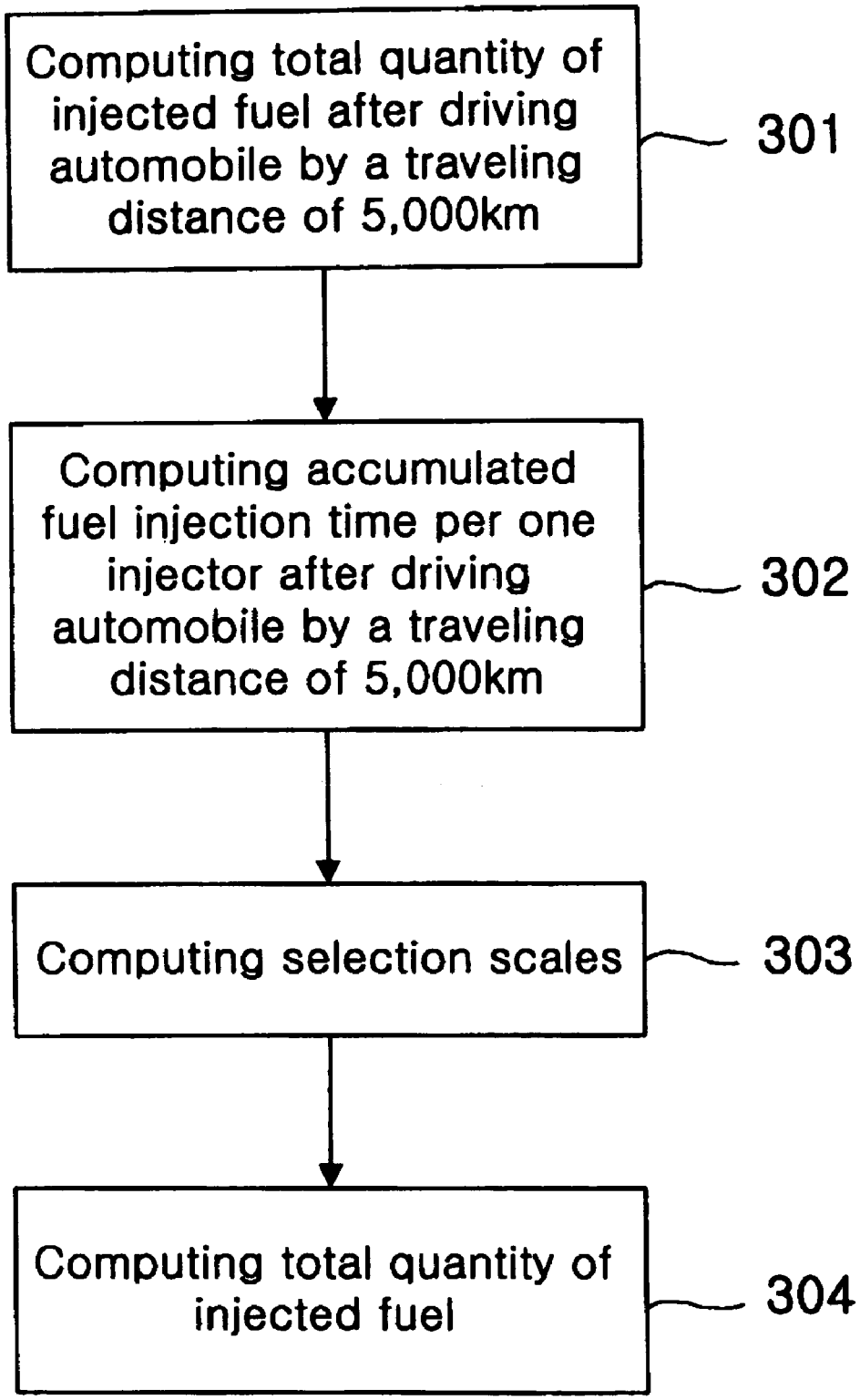

【Fig 5】
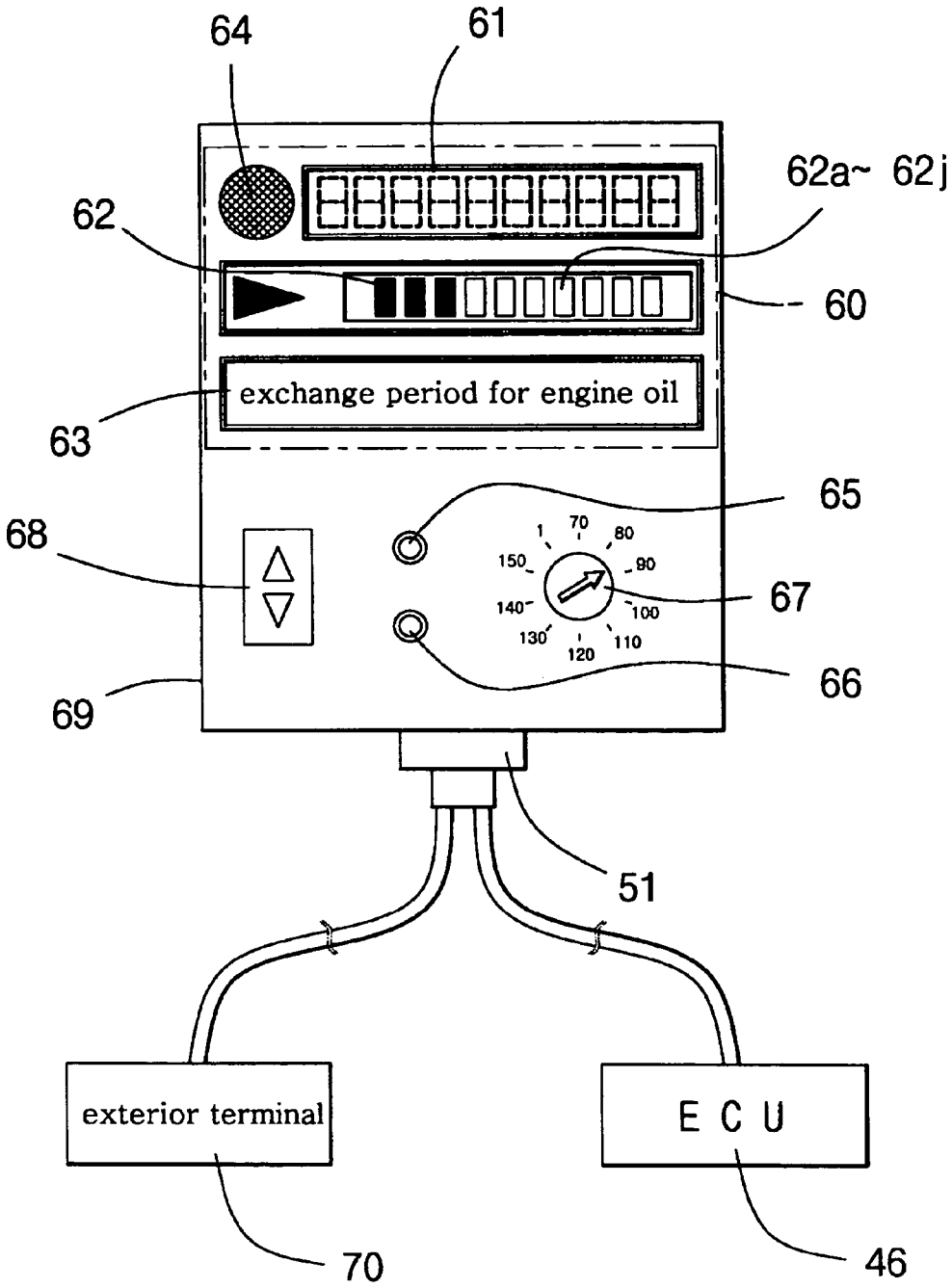

【Fig 6】
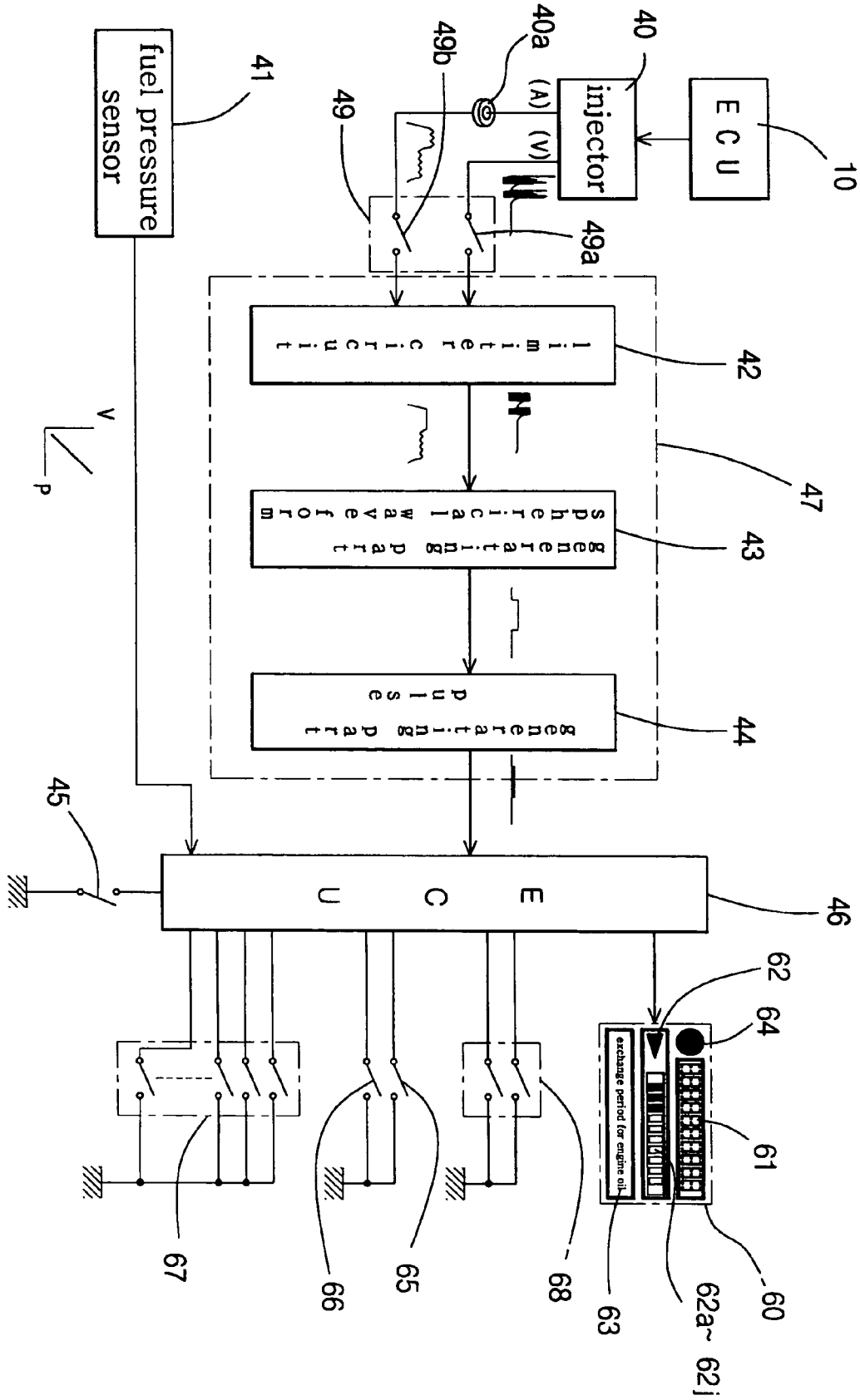

【Fig 7】
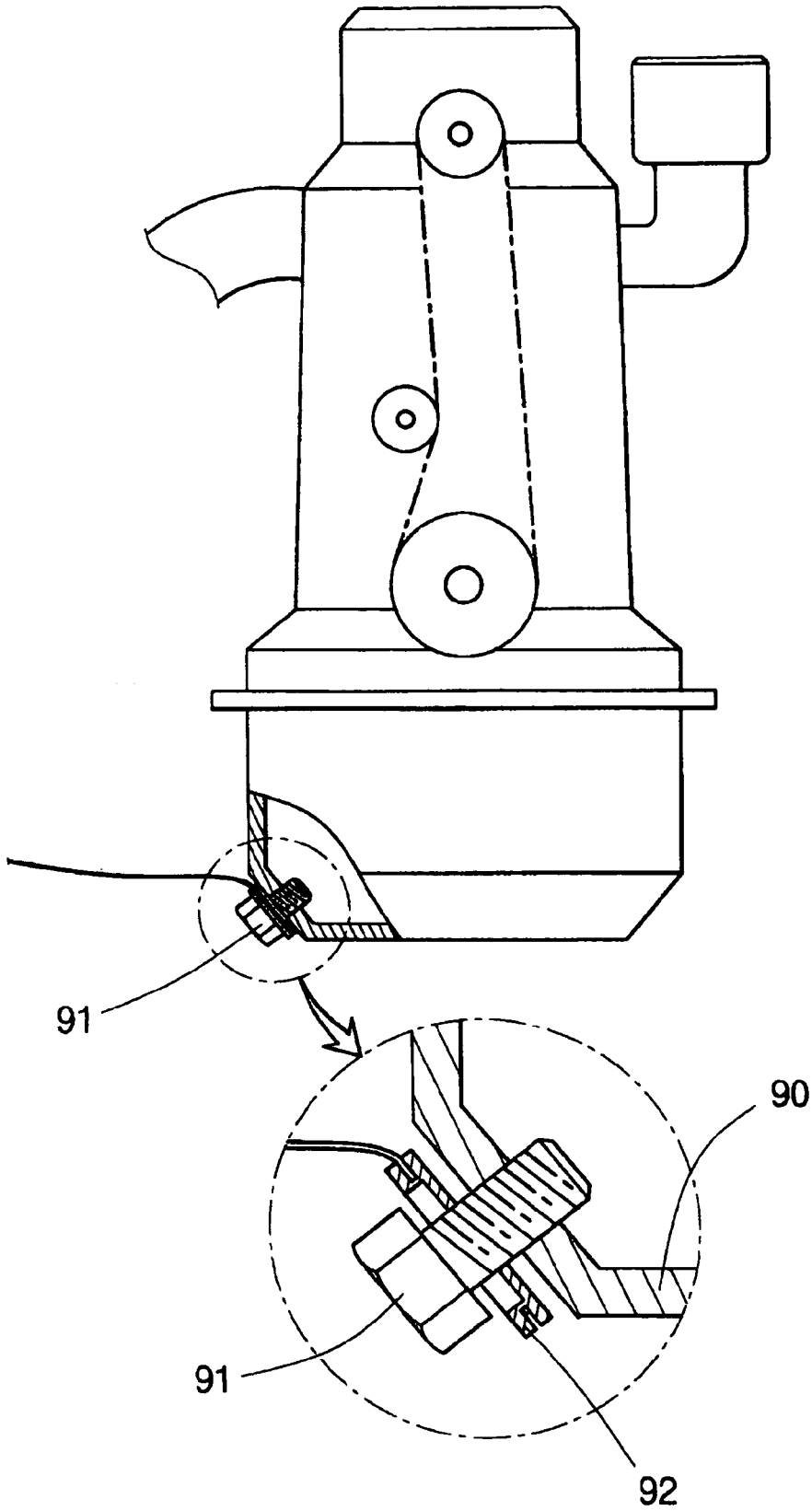

【Fig 8】
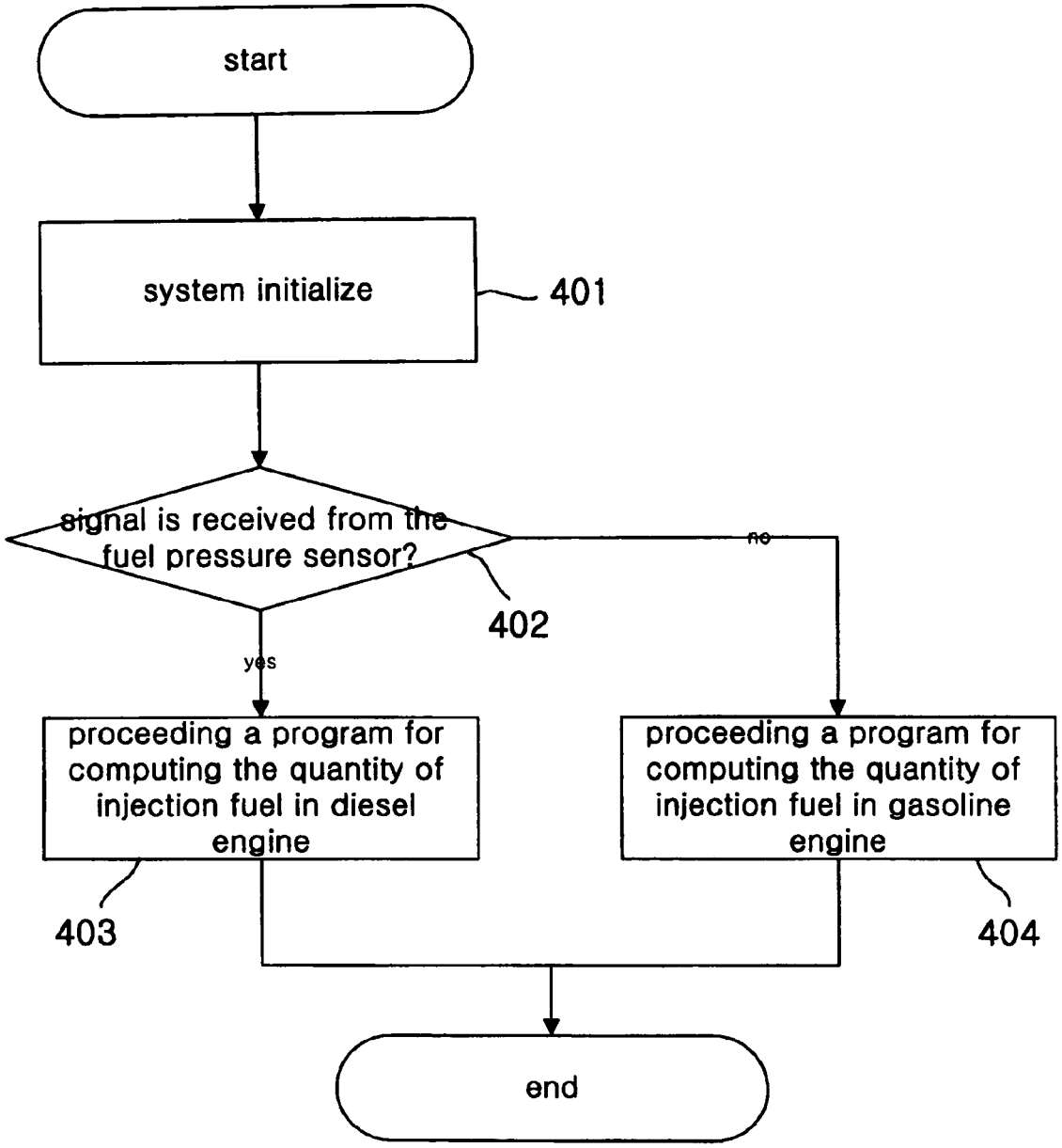

【Fig 9】
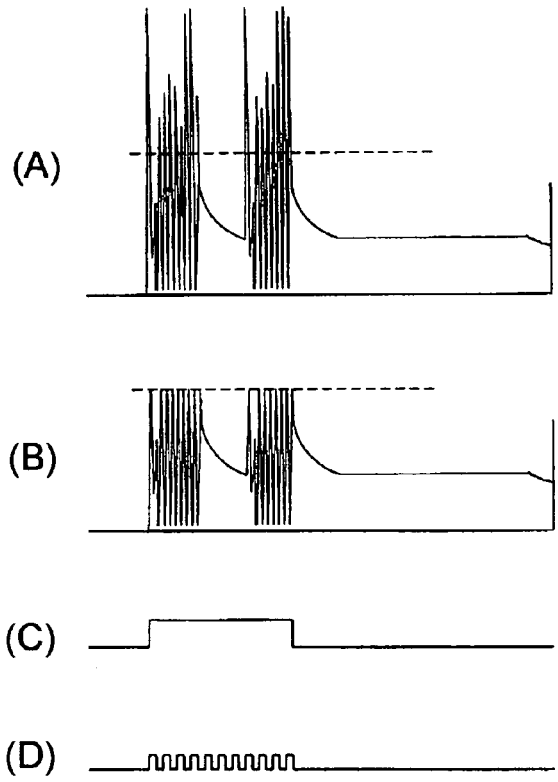
【Fig 10】
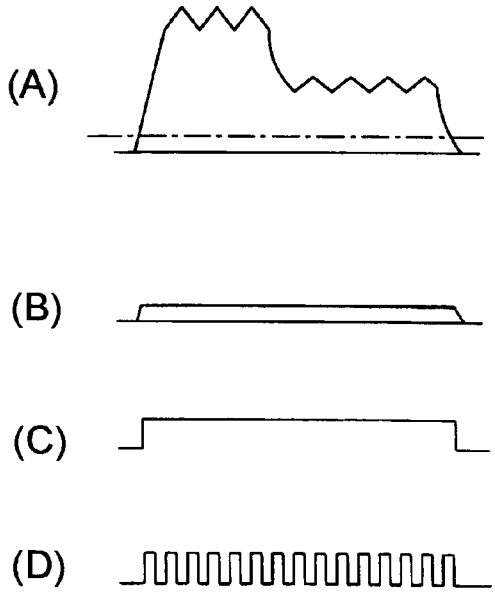

【Fig 11】
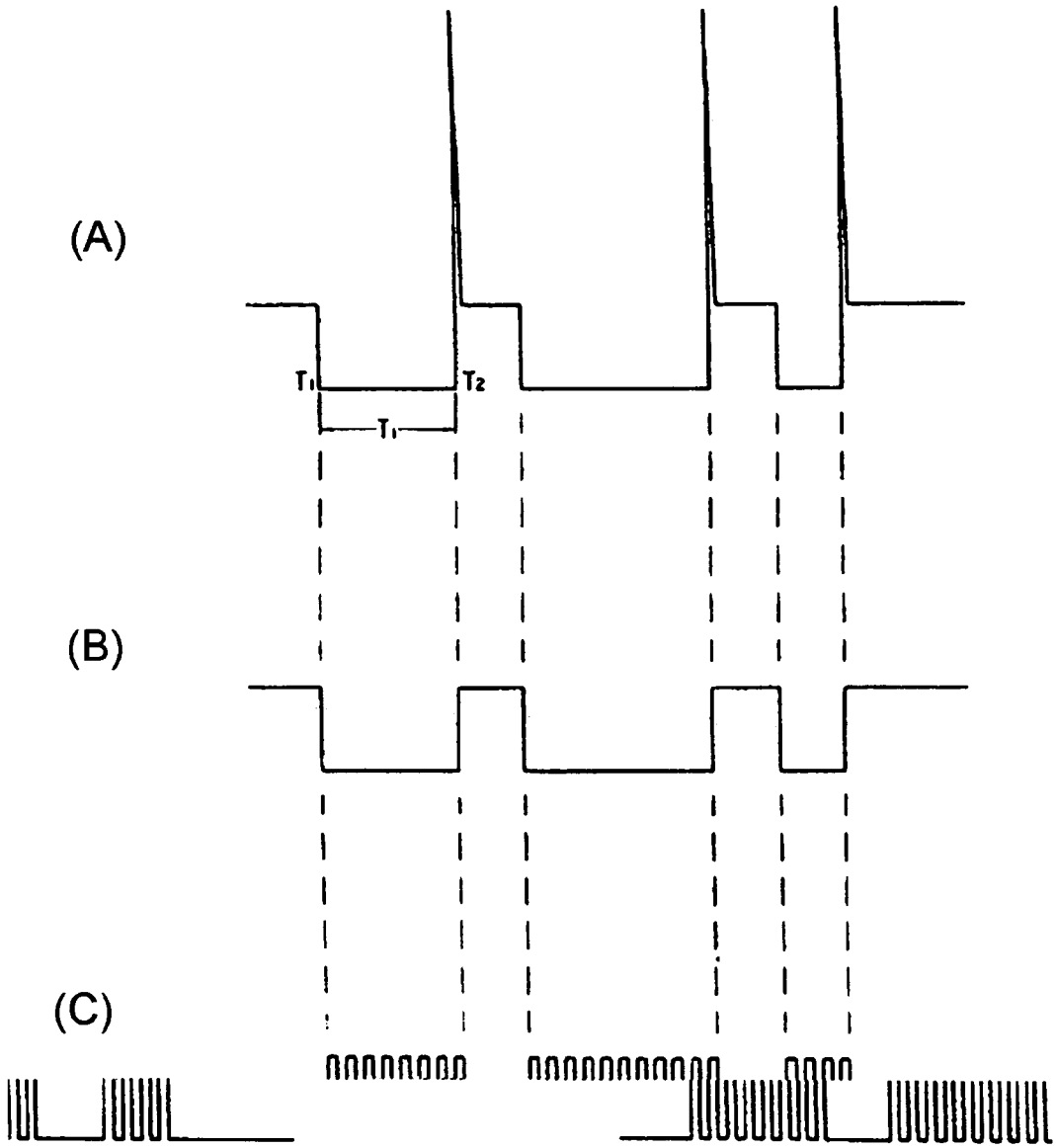

【Fig 12a】
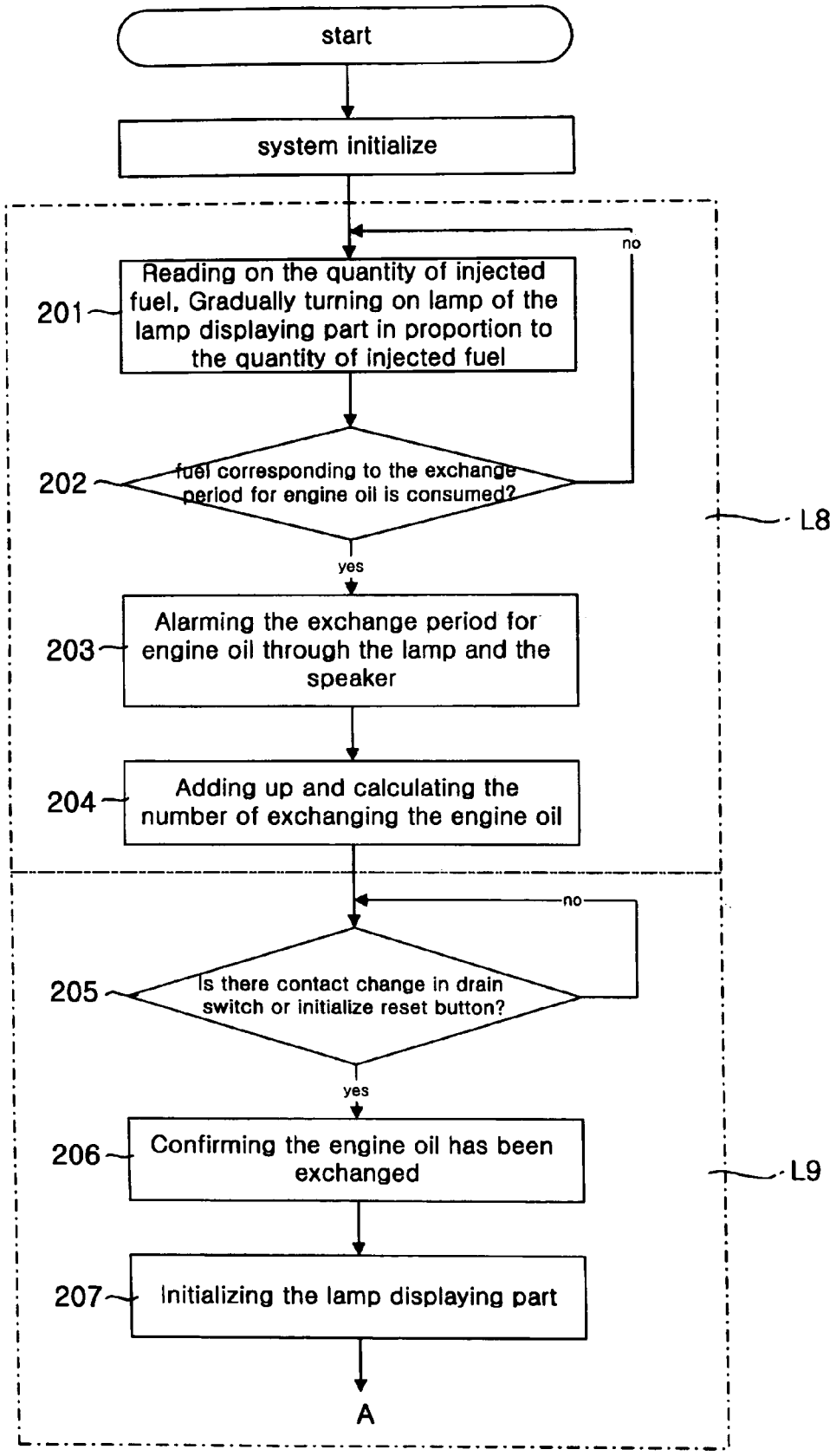

【Fig 12b】
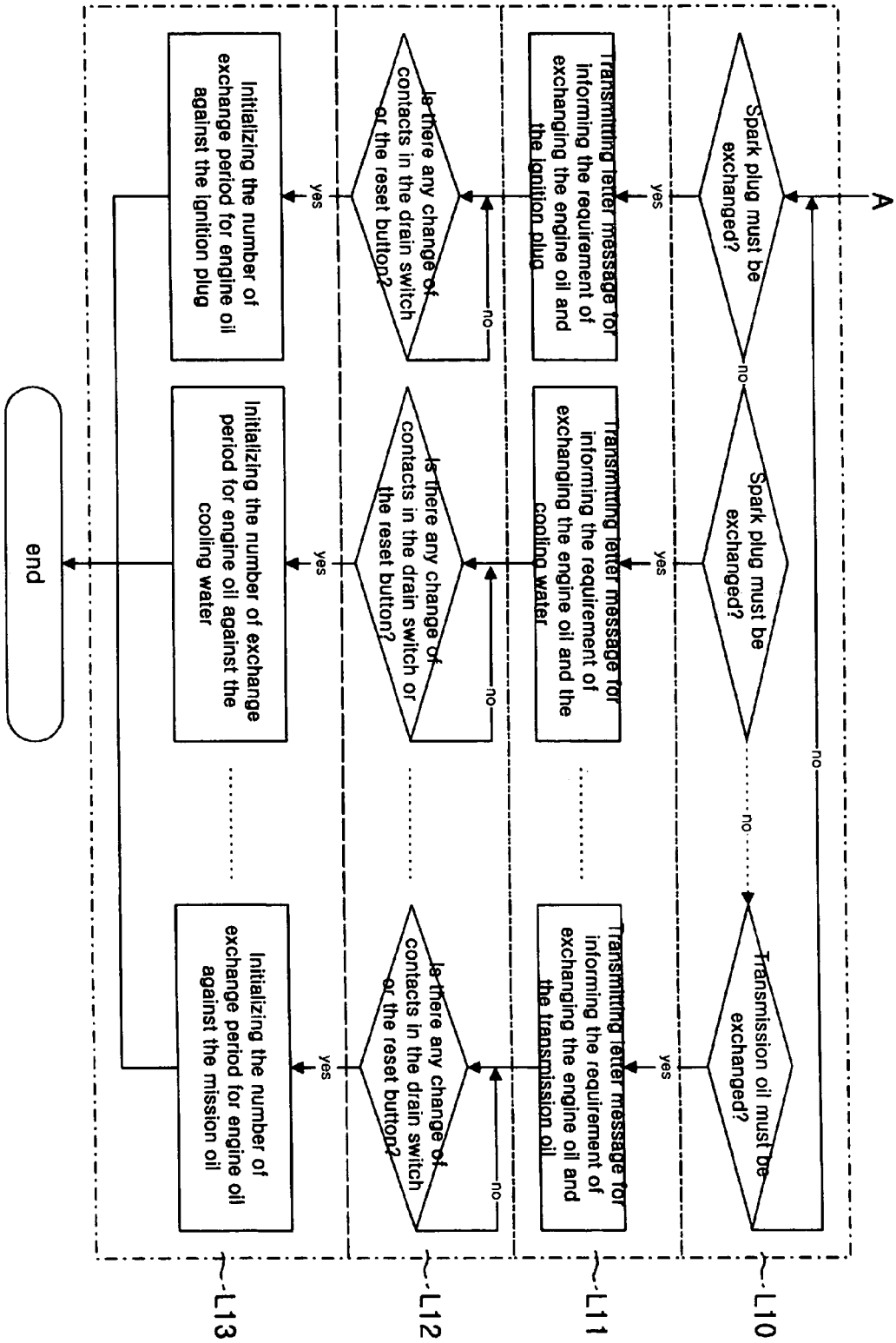

METHOD FOR COMPUTING THE QUANTITY OF INJECTED FUEL FOR AN AUTOMOBILE ENGINE EQUIPPED WITH AN ELECTRICALLY CONTROLLED FUEL INJECTION SYSTEM AND AN APPARATUS FOR DETECTING AN EXCHANGE PERIOD FOR LUBRICATING OILS AND CONSTITUTIONAL PARTS

BACKGROUND OF THE INVENTION

1. Field of the Invention

The present invention relates to a method for computing the quantity of injected fuel for an automobile engine equipped with an electronically controlled fuel injection system and an apparatus for detecting an exchange period for lubricating oils and constitutional parts, which are capable of informing an exchange period for an engine oil to a driver per use of a proper fuel quantity by calculating a total of the accumulated quantity of injected fuel for the automobile engine equipped with the electronically controlled fuel injection system, which are capable of informing the exchange period for various lubricating oils and constitutional parts to the driver in accordance with the number of exchange of the engine oil, which are capable of allowing the driver to exchange various lubricating oils and constitutional parts on a basis of accurate information under in an optimum condition, which are capable of preventing the driver from being confused, and which extend the life span of the automobile engine.

2. Description of the Prior Art

Generally, an engine oil of an automobile functions to reduce a friction and an abrasion occurred at an engine lubricating part and functions as a cooling agent, a clean agent, a sealing agent, a stress dispersing agent and so on. When an engine of the automobile is operated, an air-fuel mixture is burnt in a combustion chamber under a high temperature and thereby the oxidation and the carbonization are occurred therein. The friction and the abrasion of constitutional parts are also occurred in an engine room of the automobile. At this time, if the quantity of additives to be charged into the combustion chamber decreases or foreign materials such as a fuel oil, a moisture and so on are charged into the combustion chamber, the viscosity of an engine oil may decrease or may be increased.

When the viscosity of the engine oil decreases below a predetermined value, a power of engine may deteriorate or the automobile engine may be damaged due to the abrasion between metal surfaces of the constitutional parts. Consequently, the power of engine gets lost and the automobile engine may be broke down due to overheat of the engine.

Therefore, the engine oil must be periodically replaced. Referring to a consolidating guide distributed from an automobile manufacturer, an exchange period for the engine oil of the automobile is set to a driving state that the automobile has been traveled about 10,000 km. According to the consolidating guide, when a driver drives the automobile under severe operating condition, then he or she must exchange the engine oil of the automobile after driving the automobile by a short distance of 5,000 km.

Nevertheless, some driver, which is corresponding to 10% of the total drivers, may exchange the engine oil after driving the automobile by a very short distance of 3,000 km on a car mechanic's advice. Advices of the consolidating guide or the car mechanic are variables considered in determining whether the engine oil must be exchanged or not. An advice of a television broadcast is also variable considered in determining whether the engine oil must be exchanged or not. Accordingly, most of drivers are confused with respect to the exchange period for the engine oil.

Since there is no accurate guide for exchanging the engine oil, most of drives may determine the exchange period for the engine oil on a basis of vehicle-traveled distance. A variety of systems for informing the exchange period for various oils in a motor vehicle to a driver on a basis of vehicle-traveled distance have been proposed.

These systems are disclosed in Korean Patent Registered No. 240699(Date of Registration: Oct. 29, 1999), Korean Patent Laid-Open Publication No. 10-1998-47174(Date of Publication: Sep. 15, 1998) and Korean Utility Model Laid-Open Publication No. 20-1999-2105(Date of Publication: Jan. 15, 1999). These systems add up and compute the traveled distance of a motor vehicle and generate an alarm signal and make an on-and-off light operate so as to inform the exchange period for various oils in the motor vehicle to a driver when the accumulated distances approach to a threshold distance value.

Even these system inform the exchange period for various oils in the motor vehicle to the driver on a basis of the traveled distance, it has not been possible or practical to exactly inform the exchange period for the engine oil or the constitutional parts due to difference of running time of the automobile's engine. In other words, most of motor vehicles may be traveled in an area within the city limits at 25 km per hour and on the highway at 80~110 km per hour. The running time of the motor vehicle's engine on the highway is about 4~6 times greater than that of the motor vehicle's engine on the area within the city limits. Also, the fuel efficiency of the motor vehicle's engine on the highway is about 2~3 times greater than that of the motor vehicle's engine on the area within the city limits. Since the running time and the fuel efficiency of the motor vehicle are variables considered in determining of exchange the engine oil and the constitutional parts, it has not been possible or practical to exactly inform the exchange period for the engine oil or the constitutional parts.

SUMMARY OF THE INVENTION

Generally, engines of a gasoline motor vehicle and a diesel motor vehicle are heat engines. When a gasoline is bunt in a combustion chamber in the gasoline engine, a quantity of heat generated from the gasoline engine is transformed into a work and a discharging heat. Due to the work of the gasoline engine, the abrasion and the wear of the constitutional parts, the oxidation and the carbonization, and the introduction of mixed fuel oils may occurred in the combustion chamber and the quality of the engine oil becomes worse.

If a driver exchanges the engine oil and various parts of the engine on a basis of the vehicle-traveled distance, it is not possible or practical to exactly reflect variable vehicle running conditions such as an emergency stop, an emergency start, a traffic jam, a low-speed driving on the area within the city limits, a frequent stop for observing traffic signal, an operating of an air conditioner, a cargo on board, an engine's deterioration and so on. However, if the driver exchanges the engine oil and various parts of the engine on a basis of fuel injection quantity in the engine, it is possible or practical to exactly reflect variable vehicle running conditions as described above.

In consideration of the above-mentioned disadvantages or inconveniences of the conventional systems, the present invention provides a method for computing the quantity of injected fuel for an automobile engine equipped with an electronically controlled fuel injection system and an apparatus for detecting an exchange period for lubricating oils and constitutional parts, which are capable of informing an exchange period for an engine oil to a driver per use of a proper fuel quantity by calculating a total of the accumulated quantity of injected fuel for the automobile engine equipped with the electronically controlled fuel injection system, which are capable of informing the exchange period for various lubricating oils and constitutional parts to the driver in accordance with the number of exchange of the engine oil, which are capable of allowing the driver to exchange various lubricating oils and constitutional parts on a basis of accurate information under in an optimum condition, which are capable of preventing the driver from being confused, and which extend the life span of the automobile engine.

When the prevent invention is applied to a diesel engine equipped with an electronically controlled fuel injection system, a pulse width of a voltage (an electric current) applied to an injector in two revolution of the diesel engine is detected. Then, a pulse width during idling operation of the diesel engine at 800 rpm is calculated by using the voltage pulse width. Then, a quantity of injected fuel per pulse width during idling operation of the diesel engine at 800 rpm is computed by using the pulse width during idling operation of the diesel engine at 800 rpm. Then, a fuel pressure transform constant is obtained by extracting the square root of a fuel pressure in the injector, which is corresponding to an output voltage of a fuel pressure sensor. Thereafter, a selection scale is selected by calculating the fuel pressure transform constant and the total pulse widths. Finally, the quantity of injected fuel for the diesel engine equipped with the electronically controlled fuel injection system is accurately calculated by using the selection scale and the quantity of injected fuel per pulse width during idling operation of the diesel engine at 800 rpm.

Alternatively, when the prevent invention is applied to a gasoline engine equipped with an electronically controlled fuel injection system, total quantity of injected fuel in the gasoline engine under severe operating conditions is calculated by using a quantity of injected fuel per one injector for a one minute and a fuel efficiency. At this time, a phrase "under severe operating conditions" represents a running condition that a driver drives a motor vehicle at a traveling speed of 25 km per hour in an area within the city limits and therefore he or she must exchange an engine oil of the motor vehicle after driving the automobile by a short distance of 5,000 km. On a basis of calculating the total quantity of injected fuel, the quantity of injected fuel per one injector for one minute and the number of cylinders in the gasoline engine, an accumulated time for injecting the fuel per one injector becomes as a selection scale while the motor vehicle is being traveled at a distance of 5,000 km. Finally, the quantity of injected fuel for the gasoline engine equipped with the electronically controlled fuel injection system is accurately calculated by using the accumulated time for injecting the fuel per one injector and the selection scale.

BRIEF DESCRIPTION OF THE DRAWINGS

The above object and other characteristics and advantages of the present invention will become more apparent by describing in detail a preferred embodiment thereof with reference to the attached drawings, in which:

FIG. 1A is a graph comparatively illustrating a relationship between an output voltage of a fuel pressure sensor and a fuel pressure in an injector in a diesel engine of an automobile equipped with an electrically controlled fuel injection;

FIG. 1B shows waveforms of voltage pulses of the injector in two crank shaft revolution while the non-load idling of the diesel engine is being performed at 800 rpm, for visually illustrating each pulse width of the voltage pulses, in the diesel engine of the automobile equipped with the electrically controlled fuel injection;

FIG. 1C is a graph comparatively illustrating a relationship between an output voltage of a fuel pressure sensor and a fuel pressure in an injector in a diesel engine of another automobile equipped with an electrically controlled fuel injection system;

FIG. 2 shows waveforms of electric current pulses of the injector in two crank shaft revolution while the non-load idling of the diesel engine is being performed at 800 rpm, for visually illustrating each pulse width of the voltage pulses, in the diesel engine of the automobile equipped with the electrically controlled fuel injection;

FIG. 3 is a flow chart for illustrating a process for counting the quantity of injected fuel for a diesel engine of an automobile equipped with an electrically controlled fuel injection according to a present invention;

FIG. 4 is a flow chart for illustrating a process for counting the quantity of injected fuel for a gasoline engine of an automobile equipped with an electrically controlled fuel injection according to a present invention;

FIG. 5 shows an apparatus for detecting an exchange period for lubricating oils and constitutional parts in accordance with the quantity of injected fuel of the automobile equipped with an electrically controlled fuel injection according to the present invention;

FIG. 6 is a schematic diagram of the apparatus for detecting an exchange period for lubricating oils and constitutional parts in accordance with the quantity of injected fuel of the automobile equipped with an electrically controlled fuel injection according to the present invention;

FIG. 7 is a schematic illustration of a drain switch in the apparatus for detecting an exchange period for lubricating oils and constitutional parts in accordance with the quantity of injected fuel of the automobile equipped with an electrically controlled fuel injection according to the present invention;

FIG. 8 is a flow chart illustrating a computing routine of the gasoline engine or the diesel engine in the apparatus for detecting an exchange period for lubricating oils and constitutional parts in accordance with the quantity of injected fuel of the automobile equipped with an electrically controlled fuel injection according to the present invention;

FIGS. 9A to 9D show waveforms of voltage pulses of a fuel injection voltage in the diesel engine of the automobile equipped with the electrically controlled fuel injection and show waveforms of output powers in each step as illustrated in FIG. 6;

FIGS. 10A to 10D show waveforms of electric current pulses of a fuel injection voltage in the diesel engine of the automobile equipped with the electrically controlled fuel injection and show waveforms of output powers in each step as illustrated in FIG. 6;

FIGS. 11A to 11C show waveforms of electric current pulses of a fuel injection voltage in the diesel engine of the automobile equipped with the electrically controlled fuel injection and show waveforms of output powers in each step as illustrated in FIG. 6; and FIG. 12 is a flow chart illustrating a control routine of the apparatus for detecting an exchange period for lubricating oils and constitutional parts in accordance with the quantity of injected fuel of the automobile equipped with an electrically controlled fuel injection according to the present invention.

DETAILED DESCRIPTION OF THE INVENTION

Hereinafter, the constitution and the operation of an apparatus for detecting an exchange period for lubricating oils and constitutional parts on a basis of the quantity of injected fuel according to the preferred embodiment of the present invention will be explained in more detail with reference to the accompanying drawings FIGS. 1 to 12B. Furthermore, a method for computing the quantity of injected fuel for an automobile engine equipped with an electronically controlled fuel injection system according to the preferred embodiment of the present invention will be explained in more detail.

There have been conventionally known two types of the engine in the motor vehicle, one of which is comprised of a diesel engine equipped with an electronically controlled fuel injection system, another type of the engine is comprised of a gasoline engine equipped with an electronically controlled fuel injection system. The method for computing the quantity of injected fuel in the diesel engine is different from that of the gasoline engine. Also, there have been conventionally known two types of method for computing the quantity of injected fuel in the diesel engine.

Hereinafter, the method for computing the quantity of injected fuel in the diesel engine will be explained in more detail.

FIG. 3 shows a process for counting the quantity of injected fuel for a diesel engine of an automobile equipped with an electrically controlled fuel injection according to a present invention. At this time, the diesel engine is provided with four cylinders and has a displacement volume of 2,000 cc.

There are two types of method for computing the quantity of injected fuel in the diesel engine.

One of which is comprised of steps for computing the quantity of injected fuel on a basis of relationship between time consumed for applying an electrical voltage to an injector during injection of the fuel oil and an output voltage of a fuel pressure sensor. Another type of method is comprised of steps for computing the quantity of injected fuel on a basis of relationship between time consumed for allowing an electric current to flow through the injector during injection of the fuel and the output voltage of the fuel pressure sensor.

According to the former, a pulse width of the voltage applied to the injector in two diesel engine revolution is detected and then a pulse width is computed during idling operation of the automobile engine at 800 rpm in use with the voltage pulse width applied to the injector. Thereafter, the quantity of injected fuel in the diesel engine during idling operation of the automobile engine at 800 rpm by using the pulse width computed as described above, and thereby a fuel pressure transform constant is created on a basis of the relationship between an output voltage of the fuel pressure sensor and the pressure of the injector.

In other words, the quantity of injected fuel in the diesel engine are increased in proportion to the pulse width of the voltage applied to the injector in two crank shaft revolution of the diesel engine. As shown in FIG. 1B, it is possible to experimentally find out that four waveforms are generated from one injector in two crankshaft revolution of the diesel engine. Referring to FIG. 1A, for the sake of clarity, it is assumed that the non-load idling of the diesel engine is performed during idling operation of the automobile at 800 rpm and the fuel pressure is 263 bar and the output voltage from the fuel pressure sensor is 1.2V. Further, as shown in FIG. 1B, the voltage pulse width measured in two crank shaft revolution is 17 ms that is set as a standard value. The voltage pulse width is slightly changed in accordance with kinds of the diesel engine. This small difference in the voltage pulse width can be maintained in an error range of 17 ms.

With the above in mind, the process for computing the quantity of injected fuel in the diesel engine by using the pulse width of the voltage applied to the injector in two crank shaft revolution in the diesel engine will be explained with reference to FIG. 3.

The total quantity of injected fuel in the diesel engine is about 0.01 L per minute during operation at idle speeds of 800 rpm. Since the pulse width is 17 ms in two crank shaft revolution, the voltage pulse width during operation at idle speeds of 800 rpm is 6.8 sec as given by the following Equation (1). The voltage pulse width during operation at idle speeds of 800 rpm is slightly changed in accordance with kinds of the diesel engine. This small difference in the voltage pulse width can be maintained in an error range of 6.8 sec/min.

The voltage pulse width during operation at idle speeds of 800 rpm:

$$17\ \text{ms} \times 800 \times \tfrac{1}{2} = 6.8\ \text{sec/min} \qquad \text{Equation (1)}$$

(the step 101 as illustrated in FIG. 3)

Where, the reason why "½" is multiplied is that one injector injects a fuel at 400 times during operation at idle speeds of 800 rpm.

Accordingly, the quantity of injected fuel in the diesel engine during operation at idle speeds of 800 rpm is given as 5.295 L per hour according to the following Equation (2). The voltage pulse width during operation at idle speeds of 800 rpm is 0.1889 (hr) as given on a basis of the following Equation (3) until the fuel of 1 L has been completely consumed. The quantity of injected fuel in the diesel engine during operation at idle speeds of 800 rpm is slightly changed in accordance with kinds of the diesel engine. This small difference in the quantity of injected fuel can be maintained in an error range of 5.295 L/hr.

At this point, the quantity of injected fuel in the diesel engine during operation at idle speeds of 800 rpm is given as following Equation (2).

$$0.01\ \text{L}/6.8\ \text{sec} \times 3.600\ \text{sec} = 5.295\ \text{L/hr} \qquad \text{Equation (2)}$$

(the step 102 as illustrated in FIG. 3)

Also, the accumulated voltage pulse width during operation of the diesel engine with consuming the fuel oil of 1 L is given as following Equation (3).

$$1/5.295\ \text{L} = 0.1889\ \text{L/hr} \qquad \text{Equation (3)}$$

The following table 1 shows the results as described above.

TABLE 1

| Quantity of injected fuel in the diesel engine during operation at idle speeds of 800 rpm | | | | |
|---|---|---|---|---|
| The total quantity of injected fuel in two revolution of the diesel engine during operation at idle speeds of 800 rpm | The voltage pulse width per minute during operation at idle speeds of 800 rpm | The quantity of injected fuel per voltage pulse width during idling of the diesel engine at 800 rpm | The accumulated voltage pulse width during operation of the diesel engine with consuming fuel oil of 1 L | When the fuel pressure is 263 bar at the table 2, the fuel pressure transform constant is "1" |
| 0.01 L/min | 17 ms × 800 × 1/2 = 6.8 sec/min | 0.01 L/6.8 sec × 3.600 sec = 5.295 L/hr | 1/5.295 L = 0.1889 L/hr | |

In relationship between the pressure of injector and the quantity of injected fuel, the quantity of injected fuel in the diesel engine is proportion to a square root of the pressure to be applied to the injector.

On a basis of the following Equation (4), the pressure in the combustion chamber is substantially regular and is very smaller than the pressure (P1) of injector. The quantity of injected fuel is substantially proportion to a square root of the pressure (P1) of injector.

$$Q = \varepsilon\alpha\sqrt{\frac{2g(P1 - P2)}{\gamma}} \qquad \text{Equation (4)}$$

Where, Q represents a flow rate of a nozzle, 6 represents a calibrating constant and is 1 at the liquid, α represents a cross sectional area of the nozzle and g represents an acceleration of gravity. The pressure (P1) represents the pressure of the common rail (or injector) and the pressure (P2) represents the pressure in the combustion chamber.

Furthermore, the fuel pressure sensor in the diesel engine outputs the voltage between about 0.2~4.5V under the condition that the pressure of injector is in the range of 0~1,500 bar.

Hereinafter, a process for creating a fuel pressure constant will be explained in more detail in accordance with the relationship between the flow rate given by the Equation (4) and the output voltage generated from the fuel pressure sensor.

The following table 2 shows the fuel pressure constant by utilizing the pressure of injector in proportion to the voltage output from the fuel pressure sensor and by utilizing Equation (4).

As shown in the following table 2 and FIG. 3B, it is well known that the output voltage of the fuel pressure sensor is increased in proportion to the pressure (P1) of the injector. Also, it is well known that the quantity of injected fuel (Q) is substantially proportion to a square root of the pressure (P1) of injector and thereby it is possible to computing the fuel pressure transform constant on a basis of the output voltage of the fuel pressure sensor.

At this time, if the output voltage of the sensor is 1.2V and the pressure of injector is 263 bar, the square root of the pressure (P1) of injector becomes $\sqrt{263}$, that is 16.2. Assuming that this state is as the state of the diesel engine being operated at idle speeds of 800 rpm, the fuel pressure transform constant becomes "1" and this value becomes as a standard value. At this point, the fuel pressure transform constant corresponding to the output voltage of the fuel pressure sensor is given as following Equation (5).

$$\text{The constant} = \sqrt{\frac{fuelpressure}{standardfuelpressure}} \qquad \text{Equation (5)}$$

(the step 103 as illustrated in FIG. 3)

TABLE 2

| Quantity of injected fuel in the diesel engine during operation at idle speeds of 800 rpm | | | | |
|---|---|---|---|---|
| Output voltage of fuel pressure sensor | P1(pressure of the common rail or the injector)(bar) | $\sqrt{P1}$ | Fuel pressure transform constant | Remark |
| 4.5 | 1,500 | 38.7 | 2.39 | |
| 4 | 1,313 | 36.2 | 2.23 | |
| 3.5 | 1,125 | 33.5 | 2.06 | Engine revolution speed is 1,600 RPM; Fuel pressure of 1.125 bar is set as a severe operating condition |
| 3 | 938 | 30.6 | 1.89 | |
| 2.5 | 750 | 27.4 | 1.69 | |
| 2 | 563 | 23.7 | 1.46 | |
| 1.5 | 375 | 19.4 | 1.20 | |

TABLE 2-continued

| Quantity of injected fuel in the diesel engine during operation at idle speeds of 800 rpm | | | | |
|---|---|---|---|---|
| Output voltage of fuel pressure sensor | P1(pressure of the common rail or the injector)(bar) | $\sqrt{P1}$ | Fuel pressure transform constant | Remark |
| 1.2 | 263 | 16.2 | 1 | Speed of revolution is 800 RPM; Pressure of 263 bar is set as an idling state |
| 1.0 | 188 | 13.7 | 0.85 | |

That is, if the output voltage generated from the fuel pressure sensor is 2V, the fuel pressure transform constant is $$\frac{23.7}{16.2} = 1.46.$$

If the output voltage generated from the fuel pressure sensor is 3.5V, fuel pressure transform constant is $$\frac{33.5}{16.2} = 2.06.$$

Therefore, the fuel pressure transform constant may be calculated on a basis of the output voltage of the fuel pressure sensor. The fuel pressure transform constant is depend upon the kind of the diesel motor vehicles and may be selected by operating a dial having a selection scale thereon, which will be herein below. The selection scale selectively adjustable in accordance with the kind of the diesel motor vehicles is set as multi selection scales by using the voltage pulse width during operation at idle speeds of 800 rpm, the quantity of injected fuel in the diesel engine per the voltage pulse width given by the Equation (2), and the fuel pressure transform constant given by the Equation (5).

The following table 3 shows the selection scales on a basis of the typical severe operating conditions in which the average output voltage of the fuel pressure sensor is 3.5V, the average traveling velocity is 25 Km/hr, the average engine revolution speed is 1,600 rpm and the average fuel pressure transform constant is 2.06. This severe operating condition is similar to the practical driving condition as illustrated in above table 2. For the sake of clarity and understanding of the present invention, the range of the selection scales is at 70~150.

As shown in the following table 3, when the accumulated voltage pulse widths generated from the injector are 33.98, 38.98, 43.69, 48.54, 53.40, 58.25, 63.10, 67.96, 72.82, and 0.485, then the selection scales corresponding to the accumulated voltage pulse widths are given by multiplying each of pulse width with the fuel pressure transform constant 2.06 under severe operating condition. Thereby, the following values such as 70, 80, 90, 100, 110, 120, 130, 140, 150, 1 are set as the selection scales. In this case, the selection scales divided by the fuel pressure transform constant gives the accumulated voltage pulse width on a basis of the following Equation (6).

The accumulated voltage pulse width(hr)×the fuel pressure transform constant=the selection scale Equation (6)

(the step 104 as illustrated in FIG. 3)

The selection scale÷the fuel pressure constant=the voltage pulse width Equation (7)

TABLE 3

| Selection scale computing table by using the accumulated voltage pulse width, the quantity of injected fuel and the fuel pressure transform constant under severe operating condition | | | | | | | | | | |
|---|---|---|---|---|---|---|---|---|---|---|
| Selection scale (total length of pulse width (hr) × the fuel pressure transform constant) | 70 | 80 | 90 | 100 | 110 | 120 | 130 | 140 | 150 | 1 (selection scale of under test driving |
| Total length of pulse width (hr) (selection scale ÷ the fuel pressure transform constant | 33.98 | 38.83 | 43.69 | 48.54 | 53.40 | 58.25 | 63.10 | 67.96 | 72.82 | 0.48 |
| The quantity of injected fuel (L) (selection scale × 5.295 L/hr) | 371 | 427 | 477 | 529..5 | 582 | 635 | 688 | 741 | 794 | 5.295 |

When the accumulate voltage pulse width generated from the injector under severe operating conditions are 33.98, 38.83, 43.69, 48.54, 53.40, 58.25, 63.10, 67.96, 72.82, 0.485, then the quantity of injected fuel in the diesel engine is given by multiplying each of selection scales (70, 80, 90, 100, 110, 120, 130, 140, 150, 1) with the fuel consumed during operation at idle speeds of 800 rpm, which is given by the above Equation (2).

The selection scale×the fuel (L/hr) consumed during operation at idle speeds of 800 rpm=the total quantity (L) of injected fuel Equation (8)

Although the quantity of fuel injected in the diesel motor vehicle is variable in accordance with the voltage pulse width under severe operating condition, it is possible to cope with variable driving conditions by selecting the selection scales given by the Equation (6).

The selecting scale 1 of the table 3 is set for test drive.

Hereinafter, the above technical particulars will be explained in detail.

First, on a basis of the Equation (1), the voltage pulse width per minute (6.8 sec/min) during operation at idle speeds of 800 rpm is computed by using the voltage pulse width (17 ms) applied to the injector in two crank shaft revolution of the diesel engine.

Second, on a basis of the Equation (2), the quantity of injected fuel in the diesel engine per the voltage pulse width during operation at idle speeds of 800 rpm is given as 5.295 L by using the voltage pulse width during operation at idle speeds of 800 rpm and the total fuel quantity per minute during idling of the diesel engine at 800 rpm.

Third, on a basis of the Equation (3), the accumulated voltage pulse width during operation with consuming fuel oil of 1 L is given by using the quantity of injected fuel during idling of the diesel engine at 800 rpm per the voltage pulse width.

Fourth, the fuel pressure transform constant under severe operating conditions is given by using the Equation (5) in which the quantity of injected fuel in the diesel engine is substantially proportion to a square root of the pressure of injector.

Fifth, on a basis of the Equations (6) and (7), the selection scale is given by using the accumulated voltage pulse width during operation with consuming the fuel oil of 1 L and the fuel pressure transform constant.

Sixth, on a basis of the Equation (8), the total quantity of injected fuel is computed by using the section scale and the fuel quantity consumed in the diesel engine during idling of the diesel engine at 800 rpm.

Accordingly, when a diesel motor vehicle runs on road under severe operating conditions in which the average traveling velocity is 25 Km and the engine revolution speed is 1,600 rpm, the quantity of fuel oil consumed in the diesel engine may be computed by setting a proper selection scale in accordance with the kind of diesel motor vehicles.

For example, when a motor vehicle named as Sorrento having a fuel efficiency of 8 km/L runs on a road under severe operating condition, in which the engine oil of the motor must be changed after driving by a short distance of 5,000 km, then the quantity of fuel oil consumed is 625 L. At this time, the selection scale may be set as 120 scale(635 L) that is similar to 625 L.

Furthermore, when a motor vehicle named as Trajet XG having a fuel efficiency of 10 km/L runs on a road under severe operating condition, in which the engine oil of the motor must be changed after driving by a short distance of 5,000 km, then the quantity of fuel oil consumed is 500 L. At this time, the selection scale may be set as 100 scale (529.5 L) that is similar to 500 L.

In the secondary method for computing the quantity of injected fuel in the diesel engine, it is possible to produce the quantity of injected fuel by using the relationship between the electric current flowing time at an electric current core sensor of the injector during injection of the fuel and the output voltage of the fuel pressure sensor.

According to the secondary method for computing the fuel quantity, the pulse width of the electric current applied to the injector in two diesel engine revolution is detected. Then, a pulse width time during operation at idle speed of 800 rpm is calculated by using the electric current pulse width. Then, the quantity of the injected fuel per the pulse width during operation at idle speed of 800 rpm is computed by using the pulse width time. Finally, a fuel pressure transform constant is calculated by using the relationship between the output voltage of the fuel pressure sensor and the pressure of the injector.

Hereinafter, the relationship between the pulse width time of the electric current applied to the injector and the quantity of injected fuel in the diesel engine will be explained as follows.

Generally, according to an experiment result, the pulse width time of the electric current applied to a current core sensor in two crank shaft revolution is increased in proportion to the rpm, and thereby the quantity of injected fuel is also increased in proportion to the rpm.

Hereinafter, for the sake of clarity and under standing of the invention, the present invention will be explained with reference to a common rail diesel automobile made in Korea. As shown in FIG. 1C, if the engine revolution speed is 800 rpm during idling operation of the diesel engine, the fuel pressure is 263 bar and the output voltage of the fuel pressure sensor is 1.2V. As shown in FIG. 2, it is possible to ascertain that one waveform having the pulse width of 12 ms is generated from one injector in two crank shaft revolution. The electric current pulse width is 12 ms and it is set as a standard value. This electric current pulse width is slightly changed in accordance with kinds of the diesel engine. This small difference in the electric current pulse width can be maintained in an error range of 12 ms.

Hereinafter, the process for computing the quantity of injected fuel in the diesel engine per the electric current pulse width during operation at idle speeds of 800 rpm will be explained as follows.

As described above, since the quantity of injected fuel in the diesel engine per minute during operation at idle speeds of 800 rpm is 0.01 L and the electric current pulse width in two crank shaft revolution is 12 ms, the purse width (hr/min) is 4.8 sec during operation at idle speeds of 800 rpm, which is given by the following Equation (9). This electric current pulse width is slightly changed in accordance with kinds of the diesel engine. This small difference in the electric current pulse width can be maintained in an error range of 4.8 sec.

The electric current pulse width during operation at idle speeds of 800 rpm:

$$12\ \text{ms} \times 800\ \text{rpm} \times \tfrac{1}{2} = 4.8\ \text{sec/min} \qquad \text{Equation (9)}$$

(the step 101 as illustrated in FIG. 3)

Where, the reason why "½" is multiplied is that one injector injects a fuel at 400 times during operation at idle speeds of 800 rpm.

Accordingly, the quantity of injected fuel in the diesel engine per the electric current pulse width during operation at idle speeds of 800 rpm is 7.5 L/1 hr. The pulse width is 0.1333 (hr) until the fuel oil of 1 L is consumed, which is given by the following Equation (11).

At this time, the quantity of injected fuel in the diesel engine per the electric current pulse width during operation at idle speeds of 800 rpm is $$0.1\ \text{L}/4.8\ \text{sec} \times 3{,}600\ \text{cc} = 7.5\ \text{L/hr} \qquad \text{Equation (10)}$$

(the step 102 as illustrated in FIG. 3)

Furthermore, if the diesel engine consumes a fuel oil of 1 L, the accumulated electric current pulse width is $$\frac{1}{7.5\ \text{L}} = 0.133\ \text{L/hr.} \qquad \text{Equation (11)}$$

These values are illustrated in the following table 4.

TABLE 4

| Quantity of the injected fuel in the diesel engine per the electric current pulse width during operation at idle speeds of 800 rpm | | | |
|---|---|---|---|
| Total quantity of injected fuel during operation at idle speeds of 800 rpm | Electric current pulse width during operation at idle speeds of 800 rpm | Quantity of the injected fuel the per pulse width during operation at idle speeds of 800 rpm | Accumulated electric current pulse width time per the consumed fuel quantity of 1 L |
| 0.01 L/min | 12 ms × 800 rpm × 1/2 = 4.8 sec | 0.01 L/4.8 sec × 3,600 sec = 5.5 L/hr | 1/7.5 L = 0.1333 hr/L |

As described above, the electric current pulse width during operation at idle speeds of 800 rpm is computed and then the quantity of injected fuel in the diesel engine per the electric current pulse width during operation at idle speeds of 800 rpm is given by the Equation (10). Then, the fuel pressure transform constant is computed by the Equation (5). Finally, the selection scales which selectively adjustable in accordance with the kind of the diesel motor vehicles are calculated by using these values.

The following table 5 shows the selection scales calculated on a basis of the typical severe operating condition in which the average output voltage of the fuel pressure sensor is 3.5V, the average traveling velocity is 25 Km/hr, the engine revolution speed is 1,600 rpm, the average fuel pressure transform constant is 2.06.

As shown in the table 5, when the accumulated electric current pulse widths generated from an electric current core sensor of the injector are 33.98, 38.98, 43.69, 48.54, 53.40, 58.25, 63.10, 67.96, 72.82, 0.485, then the selection scales corresponding to the accumulated electric current pulse widths are given by multiplying each of pulse width with the fuel pressure transform constant 2.06 under severe operating condition. Thereby, the following values such as 70, 80, 90, 100, 110, 120, 130, 140, 150, 1 are set as the selection scales. In this case, the selection scales divided by the fuel pressure transform constant gives the accumulated electric current pulse width on a basis of the following Equation (13).

The accumulated electric current pulse width(hr)×the fuel pressure transform constant=the selection scale — Equation (12)

(the step 104 as illustrated in FIG. 3)

The selection scale÷the fuel pressure transform constant=the accumulated electric current pulse width — Equation (13)

When the pulse width of the voltage waveform generated from the electric current core sensor of the injector under severe operating condition are 33.98, 38.98, 43.69, 48.54, 53.40, 58.25, 63.10, 67.96, 72.82, 0.485, then the quantity of injected fuel in the diesel engine is given by multiplying each of selection scales (70, 80, 90, 100, 110, 120, 130, 140, 150, 1) with the quantity (7.5 L) of fuel consumed during operation at idle speeds of 800 rpm, which is given by the above Equation (10).

The selection scale×the quantity (L/hr) of fuel consumed during operation at idle speeds of 800 rpm=the total quantity (L) of injected fuel — Equation (14)

TABLE 5

| Selection scale computing table by using the accumulated times corresponding to a voltage pulse width under severe operating condition, the quantity of injected fuel the diesel engine, and the constant of the fuel pressure | | | | | | | | | | |
|---|---|---|---|---|---|---|---|---|---|---|
| Selection scales (Total electric current pulse width(hr) × fuel pressure transform constant | 70 | 80 | 90 | 100 | 110 | 120 | 130 | 140 | 150 | 1 (Selection scale of test drive) |
| Total length of pulse width(hr)(Selection scales ÷ fuel pressure transform constant(2.06)) | 33.98 | 38.83 | 43.69 | 48.54 | 53.40 | 58.25 | 63.10 | 67.96 | 72.82 | 0.485 |
| Quantity of injected fuel(L)(Selection scale × 7.5 L/hr) | 525 | 600 | 675 | 750 | 825 | 900 | 975 | 1,050 | 1,125 | 7.5 |

Although the quantity of fuel injected in the diesel motor vehicle is variable in accordance with the electric current pulse width under severe operating condition, it is possible to cope with variable driving conditions by selecting the selection scales given by the Equation (12).

The selecting scale 1 of the table 5 is set for test drive.

Hereinafter, the above technical particulars will be explained in detail.

First, on a basis of the Equation (1), the electric current pulse width per minute (4.8 sec/min) during operation at idle speeds of 800 rpm is computed by using the electric current pulse width (12 ms) applied to the injector in two crank shaft revolution of the diesel engine.

Second, on a basis of the Equation (10), the quantity of injected fuel in the diesel engine per hour during operation at idle speeds of 800 rpm is given as 7.5 L by using the electric current pulse width per minute (4.8 sec/min) during operation at idle speeds of 800 rpm and the total fuel quantity per minute during idling of the diesel engine at 800 rpm.

Third, on a basis of the Equation (11), the accumulated electric current pulse width during operation with consuming fuel oil of 1 L is given by using the quantity of injected fuel per hour during idling of the diesel engine at 800 rpm.

Fourth, the fuel pressure transform constant under severe operating conditions is given by using the Equation (5) in which the quantity of injected fuel in the diesel engine is substantially proportion to a square root of the pressure of injector.

Fifth, on a basis of the Equations (12) and (13), the selection scale is given by using the accumulated electric current pulse width during operation with consuming the fuel oil of 1 L and the fuel pressure transform constant.

Sixth, on a basis of the Equation (14), the total quantity of injected fuel is computed by using the section scale and the fuel quantity consumed in the diesel engine during idling of the diesel engine at 800 rpm.

Accordingly, when a diesel motor vehicle runs on road under severe operating conditions in which the average traveling velocity is 25 Km and the engine revolution speed is 1,600 rpm, the quantity of fuel oil consumed in the diesel engine may be computed by setting a proper selection scale in accordance with the kind of diesel motor vehicles.

For example, when a motor vehicle named as Sorrento having a fuel efficiency of 8 km/L runs on a road under severe operating condition, in which the engine oil of the motor must be changed after driving by a short distance of 5,000 km, then the quantity of fuel oil consumed is 625 L. At this time, the selection scale may be set as 80 scale(600 L) that is similar to 625 L.

Furthermore, when a motor vehicle named as Trajet XG having a fuel efficiency of 10 km/L runs on a road under severe operating condition, in which the engine oil of the motor must be changed after driving by a short distance of 5,000 km, then the quantity of fuel oil consumed is 500 L. At this time, the selection scale may be set as 70 scale(529 L) that is similar to 500 L.

In the case of computing the quantity of injected fuel by using the relationship between the electric current pulse width or the voltage pulse width applied to the injector during injection of the fuel oil and the output voltage of the fuel pressure sensor, as shown in the table 3 and 5, the accumulated pulse width to the selection scale is same for each the selection scales. At this point, the quantity of fuel consumed is slightly different. Next, the voltage waveform generated from the injector may be used or the electric current waveform generated from the electric current core sensor may be used due to operation of the mode selection part.

Furthermore, in the present invention, the fuel pressure transform constant is produced on a basis of the fact that it is proportion to a square root of the fuel pressure of the injector. In order to simplify a circuit or a program, it is possible to set the fuel pressure transform constant on a basis of a value that is proportion to the output voltage of the fuel pressure sensor.

As shown in FIG. 1C, the graph "A" is the conventional graph which is given by a square root of the fuel pressure of the injector in the relationship between the output voltage (y axis) of the fuel pressure sensor and the fuel pressure transform constant (x axis).

The graph "B" can be used for setting the fuel pressure transform constant because it may be a first linear line corresponding to the relationship $$y = \frac{4.5 - 1.2}{2.39 - 1} + b.$$

Where, the graph "B" lies in an error range of ±3% relative to the graph "A", as shown in FIG. 1C.

In the present invention, for the sake of clarity and understanding of the present invention, the selection scales may be set at 10 unit. Alternatively, if the selection scales are set smaller than 10 unit, it is possible to enhance the exactness.

FIG. 4 is a flow chart for illustrating a process for counting the quantity of injected fuel for a gasoline engine of an automobile equipped with an electrically controlled fuel injection according to a present invention. Referring to FIG. 4, the total quantity of injected fuel in the diesel engine under severe operating condition, in which the engine oil must be exchanged after driving the automobile by a short distance of 5,000 km, is computed by using the fuel quantity of injected from one injector per one minute and the fuel efficiency. On a basis of calculating the total quantity of injected fuel, the quantity of injected fuel per one injector for one minute and the number of cylinders in the gasoline engine, an accumulated time for injecting the fuel per one injector becomes as a selection scale while the motor vehicle is being traveled at a distance of 5,000 km under severe operating conditions. Finally, the quantity of injected fuel for the gasoline engine equipped with the electronically controlled fuel injection system is accurately calculated by using the accumulated time for injecting the fuel per one injector and the selection scale.

Generally, the quantity of fuel injected from one injector of the gasoline engine per one minute, which is manufactured form the automobile manufacturing company, must be disclosed in accordance with the kind of the automobiles. By using data such as the quantity (a) of fuel injected form one injector per one minute, the traveling distance and the fuel efficiency (b) and so on, the fuel injection accumulated time per one injector after driving the automobile by a short distance of 5,000 km may be calculated.

$$\frac{5{,}000\ \text{km}}{\textit{fuelefficiency}} = \text{the quantity of injected fuel after driving the automobile by a short distance of 5,000 km} \quad \text{Equation (15)}$$

(the step 301)

Accordingly, the fuel injection accumulated time per one injector after driving the automobile by a short distance of 5,000 km may be calculated in accordance with the kind of the automobiles on a basis of the following Equation (16).

(Total quantity of injected fuel in the diesel engine after driving the automobile by a short distance of 5,000 km×1,000)÷(the quantity of fuel injection from one injector per one minute×60×the number of cylinders)=the accumulated fuel injection time per one injector after driving the automobile by a short distance of 5,000 km Equation (16)

(the step 302)

In the above Equation (16), the reason why "1,000" is multiplied is that the quantity (a) of fuel injected form one injector per one minute is typically expressed at cc unit and the fuel efficiency (b) is typically expressed at L unit and therefore the quantity of injected fuel must be expressed as cc unit. Also, the reason why "60" is multiplied is that the quantity (a) of fuel injected form one injector per one minute must be expressed as minute unit.

The selection scale is computed by using the fuel injection accumulated time per one injector after driving the automobile by a short distance of 5,000 km, which is given by the above Equation (16).

As shown in the following Equation (17), the fuel injection accumulated time per one injector after driving the automobile by a short distance of 5,000 km is multiplied by 10 and then a positive number is only taken without calculating down to the decimal place so as to set the selection scale.

the fuel injection accumulated time per one injector after driving the automobile by a short distance of 5,000 km×10=the selection scale Equation (17)

(the step 303)

Where, an obtained selection scale must be set to a positive number without calculating down to the decimal place.

In the above Equation (17), the reason why "10" is multiplied is that the selection scale given by the Equation (17) must be coincide with the selection scale given by the Equation (12). Thus, it is possible to commonly use the selection scale dial in the diesel engine and the gasoline engine.

Accordingly, if the selection scale is multiplied by the accumulated fuel injection time per one injector, the total quantity of injected fuel can be obtained.

$$\text{Selection scale} \times \frac{1}{10} \times \text{the number of cylinders} \times \text{the quantity(cc) of fuel injection from one injector per one minute} \times \frac{60\ \text{minute}}{1{,}000\ cc} = \text{the quantity(L) of injected fuel} \quad \text{Equation (18)}$$

(the step 304)

The following table 6 shows the quantity of fuel injected from one injector per one minute (a), the fuel efficiency (b), the total quantity(c) of fuel consumed after driving the automobile by a short distance of 5,000 km, the accumulated injection time (d) per one injector after driving the automobile by a short distance of 5,000 km and the selection scales.

TABLE 6

| | Classification | | | | |
|---|---|---|---|---|---|
| | Quantity of | | Driving at 5,000 km | | |
| Vehicle name | injected fuel at one injector per one minute(a) | Fuel efficiency(b) | 5,000 ÷ (b) | (c) × 1000 ÷ (a) ÷ 60 ÷ number of cylinders | Selection scale (d × 10) |
| Verna, Avante (Four cylinders) | 170 cc/min | 11 km/L | 454.5 L | 11.13 hr | 110 |
| Spectra, Suma (1.8DOHC, Four cylinders) | 220 cc/min | 8.5 km/L | 588.2 L | 11.14 hr | 110 |
| Grandeur XG (2.5) (Six cylinders) | 200 cc/min | 6 km/L | 833 L | 11.56 hr | 110 or 120 |
| EF Sonata, Optima (Four cylinders) | 311 cc/min | 6.5 km/L | 769 L | 10.3 hr | 100 |
| Grandeur 3.0, Equus 3.0 (Six cylinders) | 253 cc/min | 5 km/L | 1,000 L | 10.97 hr | 100 or 110 |
| Test Drive | | | | 0.1 hr | First scale |

For example, as shown in Table 6, when the gasoline automobile is a motor vehicle named Verna having a fuel quantity of 170 cc/min per one injector and four-cylinders, the accumulated injection time of one injector is 11.13 minute, then the quantity of fuel consumed is 454.5 L. Preferably, the engine oil may be exchanged after driving the automobile with consuming the fuel oil of 454.5 L, which is corresponding to the accumulated injection time of 11 hr. Accordingly, the selection scale may be set as 110.

As described above, the user can exchange the engine oil after driving the automobile with consuming a proper quantity of fuel oil by operating the selection scale dial, as shown in FIG. 5, of the apparatus for detecting an exchange period for lubricating oils and constitutional parts and by using the quantity of injected fuel oil.

FIG. 5 shows an apparatus for detecting an exchange period for lubricating oils and constitutional parts in accordance with the quantity of injected fuel of the automobile equipped with an electrically controlled fuel injection according to the present invention.

A display part 60 comprises a fuel quantity displaying part 61, a lamp displaying part 62, a speaker 64, and an exchange part display portion 63. The fuel quantity displaying part 61 for displaying the accumulated quantity of injected fuel in the motor vehicle as a numeral value is installed on a front side surface of a rectangular shape case 69. Furthermore, the lamp displaying part 62 for displaying an exchange period for an engine oil as lamps 62*a*~62*j* is installed on the front side surface of the case 69. The speaker 64 for alarming the exchange period for various oil and constitutional parts as a sound is installed on the front side surface of the case 69. The exchange part display portion 63 for displaying the part to be changed as a letter is also installed on the front side surface of the case 69.

A selection scale dial 67 for setting the exchange period for the engine oil in accordance with the kind of automobiles is installed at a lower side of the display part 60 on the front side surface of the case 69. An up/down button 68 is installed at a position adjacent to the dial 67 on the front side surface of the case 69. This up/down button 68 allows a user for selectively setting various oils and the kind of constitutional parts to be changed in accordance with the kind of automobiles and the driving condition. Accordingly, the driver can ascertain the exchange period for the engine oil and the constitutional parts. An input button 65 is also installed at the lower side of the display part 60 on the front side surface of the case 69. If a user wants to directly input information relative to the part displayed on the exchange part display portion 63, he or she can input the information by directly operating the input button 65. A reset button 66 for setting the display to be initiated is also installed at the lower side of the display part 60 on the front side surface of the case 69. The reset button 66 has the same function as that of a drain switch, which will be explained herein below.

FIG. 6 is a schematic diagram of the apparatus for detecting an exchange period for lubricating oils and constitutional parts in accordance with the quantity of injected fuel of the automobile equipped with an electrically controlled fuel injection according to the present invention.

As shown in FIG. 6, a voltage waveform output terminal (V) of an injector 40 and an electric current waveform output terminal (A) of an electric current core sensor 40*a* are selectively connected to a wave shaping circuit 47 due to operation of a mode selecting part 49. The output terminal of the wave shaping circuit 47 is connected to an input terminal of a microprocessor unit (hereinafter, referred to "MPU") 46. A fuel pressure sensor 41 for outputting a voltage in proportion to the pressure of the injector 40 is also connected to another input terminal of the MPU 46. A drain switch 45 is also connected to another input terminal of the MPU 46. The drain switch 45 initializes the lamp displaying part 62 while it is being separated from an engine oil fan or it is being contacted with the engine oil fan so as to exchange the engine oil.

The fuel quantity displaying part 61 for adding up and displaying the quantity of injected fuel in the motor vehicle as a numerical value is connected to the output terminal of the MPU 46. The lamp displaying part 62 for displaying the exchange period for the engine oil as the lamps 62*a*~62 is connected to the output terminal of the MPU 46. The speaker 64 for alarming the exchange period for various oils and constitutional parts as a sound is connected to the output terminal of the MPU 46. The display part 60 comprising the exchange part displaying portion 63 for displaying the parts to be changed as a letter is connected to the output terminal of the MPU 46.

At this time, the fuel quantity displaying part 61 and the lamp displaying part 62 of the displaying part 60 can be embodied as a digital displaying device, which is capable of displaying a proceeding state as a numerical value of the rate (%).

The selection scale dial 67 for setting the exchange period for the engine oil in accordance with the kind of automobiles under severe operating conditions is connected to the input terminal of the MPU 46. The up/down button 68 is also connected to the input terminal of the MPU 46. This up/down button 68 allows a user for selectively setting the kinds of various oils and constitutional parts to be exchanged in accordance with the kind of automobile and the driving condition, and thereby the user can ascertain the exchange period for the engine oil and the constitutional parts. The reset button 66 is connected to the input terminal of the MPU 46. The reset button 66 for initializing the lamps 62*a*~62*j* during exchange of the engine oil is also connected to the input terminal of the MPU 46.

The mode selecting part 49, which comprises a voltage selecting switch 49*a* and an electric current selecting switch 49*b*, is connected to the other side terminal of the MPU 46. The voltage selecting switch 49*a* allows the user for selecting a desired voltage waveform generated from the injector 40. The electric current selecting switch 49*b* allows the user for selecting a desired electric current waveform generated from the electric current core sensor 40*a*.

Since it is preferable to extrude the voltage waveform generated from the injector 40 or to extrude the electric current waveform generated form the electric current core sensor 40*a* in accordance with the kind of diesel automobiles, the user can select the voltage waveform or the electric current waveform by operating the mode selecting part 49. In other words, it is possible to select the voltage waveform or the electric current waveform for the convenience of installation.

The wave shaping circuit 47 comprises a limiter circuit 42, a spherical waveform generating part 43 and a pulse generating part 44. The limiter circuit 42 limits the amplitude of the voltage (or electric current) waves generated from the injector 40 and the electric current core sensor 40*a* by removing the voltage (or electric current) waveforms more than a predetermined level. The spherical waveform generating part 43 is connected to the output terminal of the limiter circuit 42 and makes the voltage (or electric current) waveforms of which the amplitude is limited below a predetermined level into a spherical waveform. The pulse generating part 44 makes the spherical waveform generated from the spherical waveform generating part 43 into a cluck having a predetermined cycle. The wave shaping circuit 47 is installed in the case 69. Preferably, the wave shape circuit 47 is installed in the case together with an electronic control unit (hereinafter, referred to "ECU") 10.

The constitution of the drain switch 45 is shown in FIG. 7. A circumferential groove is formed along the circumference of a groove-shaped washer 92. A conductive wire is introduced and wound into the groove. When a drain bolt 91 is rotated, the conductive wire does not rotated. This conductive wire is connected to the MPU 46.

The MPU 46 can automatically judge the kind of automobiles. If the automobile has a diesel engine, the MPU 46 begins to perform a diesel fuel quantity-calculating program. Likewise, if the automobile has a gasoline engine, the MPU 46 begins to perform a gasoline fuel quantity-calculating program.

In other words, the MPU 46 judges the kind of the automobile on a basis of the signal generated from the fuel pressure sensor 41. The fuel pressure sensor 41 is only presented at the diesel engine. As shown in FIG. 8, if the MPU receives the signal from the fuel pressure sensor 41, the MPU judges the kind of the automobile as the diesel engine. Alternatively, if the MPU does not receive the signal from the fuel pressure sensor 41, the MPU judges the kind of the automobile as the gasoline engine.

The MPU 46 stores a plurality of selection scales as shown in Tables 3 and 5, an accumulated pulse width time corresponding to the selection scales, and the quantity of fuel consumed. The MPU 46 reads on the accumulated pulse width time of the voltage waveform generated from the injector 40 or the electrical current waveform generated from the electric current core sensor 40*a* and a fuel pressure transform constant corresponding to the voltage generated from the fuel pressure sensor 41. Thereafter, the MPU 46 computes the quantity of injected fuel. If the fuel corresponding to the preset selection scale has been consumed, the MPU 46 informs the exchange period for engine oil to the user due to the computing program.

The following table 7 shows the selection scales according to the kind of the automobiles, which are stored in the MPU 46.

This table shows the exchange period for various lubricating oils and constitutional parts taking into consideration of the fuel efficiency according to the kind of the automobiles and the fuel quantity after driving the automobile by a short distance of 5,000 km. The driver can select the selection scale with reference to the tables 3 or 5.

If a driver selects the selection scales corresponding to the kind of automobiles owned by the driver by operating the dial 67 on a basis of the tables 3 or 5, the MPU 46 adds up and computes the voltage (or electric current) pulse widths generated from the injector 40 and then makes the quantity of injected fuel corresponding to the selection scale to be displayed on the fuel quantity displaying part 61 and informs the exchange period for the engine oil to the driver through the speaker 64.

The MPU 46 stores data relative to the exchange period for the various oils and the constitutional parts in accordance with the number of replacement to the engine oil.

TABLE 7

Table for setting selection scales according to the kind of automobiles

| Selection scale | The kind of automobile |
|---|---|
| 70 | ⓐ, ⓙ |
| 80 | ⓑ, ⓚ |
| 90 | ⓒ, ⓛ |
| 100 | ⓓ, ⓜ |
| 110 | ⓔ, ⓝ |
| 120 | ⓕ, ⓞ |
| 130 | ⓖ, ⓟ |
| 140 | ⓗ, ⓠ |
| 150 | ⓘ, ⓡ |

The following table 8 shows the exchange period for the various oils and the constitutional parts in accordance with the number of replacement to the engine oil in the MPU 46.

TABLE 8

Exchange period for the various oils and the constitutional parts in accordance with the number of replacement to the engine oil

| Exchange parts | Traveling distance (Km) | The number of replacement to the engine oil |
|---|---|---|
| Engine oil | 5,000 | |
| Ignition Plug | 20,000 | 5 |
| Mission oil | 40,000 | 8 |
| Brake oil | 40,000 | 8 |
| Fuel filter | 20,000 | 4 |
| Cooling water | 40,000 | 8 |
| Front brake lining | 30,000 | 6 |

Hereinafter, the operational process of the apparatus for detecting an exchange period for lubricating oils and constitutional parts on a basis of the selection scale selected in accordance with the kind of automobiles will be explained.

If an automobile begins to be operated, the MPU 46 initializes the system as shown in FIG. 8 (=step 401). Then, the MPU 46 judges whether a signal receives from the fuel pressure-sensing sensor 41 or not (=step 402).

At this time, if the MPU receives the signal from the fuel pressure sensor 41, the MPU judges the kind of the automobile as the diesel engine and performs the diesel engine fuel-computing program (=steps 403). Alternatively, if the MPU does not receive the signal from the fuel pressure sensor 41, the MPU judges the kind of the automobile as the gasoline engine and performs the gasoline engine fuel-computing program (=steps 404).

When a user turns on the voltage selecting switch 49*a* of the mode selecting part 49 in the diesel engine, an operational process of the gasoline engine fuel-computing program will be proceed. Hereinafter, the operational process of the gasoline engine fuel-computing program will be explained.

If a voltage having a waveform as shown in FIG. 9A is applied to the injector 40 from the ECU 10 so as to supply the diesel engine with a fuel, this voltage waveform passes through the wave shaping circuit 47 as shown in FIG. 6 and thereby the voltage pulse width may be generated.

In other words, if a voltage having a waveform as shown in FIG. 9A is applied to the injector 40 from the ECU 10 so as to supply the diesel engine with a fuel, this voltage waveform is inputted to the limiter circuit 42 of the wave shaping circuit 47. At this time, voltage waveform more than a predetermined level is removed and other voltage waveform having limited amplitude is applied to the spherical waveform generating part 43. Consequently, a safety spherical waveform may be output as shown in FIG. 9C during generation of the voltage waveform from the injector 40.

The safety spherical waveform generated from the spherical waveform generating part 43 is applied to the pulse generating part 44 and thereby a pulse is generated during generation of the spherical waveform as shown FIG. 9D. The MPU 46 computes the pulse so as to produce the voltage pulse width.

When a user turns on the electric current selecting switch 49*b* of the mode selecting part 49 of the apparatus for detecting an exchange period for lubricating oils and constitutional part in the diesel engine, an operational process of the diesel engine fuel-computing program will be proceed. Hereinafter, the operational process of the diesel engine fuel-computing program will be explained.

If an electric current having a waveform as shown in FIG. 10A is applied to the injector 40 from the ECU 10 so as to supply the diesel engine with a fuel, this electric current waveform passes through the wave shaping circuit 47 as shown in FIG. 6 and thereby a cluck may be generated. The MPU 46 computes this cluck and then calculates time required for supplying fuel oil.

In other words, if an electric current having a waveform as shown in FIG. 10A is applied to the injector 40 from the ECU 10 so as to supply the diesel engine with a fuel, this electric current waveform is inputted to the limiter circuit 42 of the wave shaping circuit 47. At this time, electric current waveform more than a predetermined level is removed and other electric current waveform having limited amplitude is applied to the spherical waveform generating part 43. Consequently, a safety spherical waveform may be output as shown in FIG. 10C during generation of the electric current waveform from the injector 40.

The safety spherical waveform generated from the spherical waveform generating part 43 is applied to the pulse generating part 44 and thereby a cluck is generated during generation of the spherical waveform as shown FIG. 10D. The MPU 46 computes the pulse so as to produce the electric current pulse width.

Hereinafter, the process of informing the exchange period for the engine oil and an information relative to the diesel automobile to the driver by measuring the voltage (or the electric current) pulse width and calculating the quantity of injected fuel at the MPU 46 will be explained with reference to following embodiments 1 to 4 in detail.

EMBODIMENT 1

Typical Driving Condition

In the embodiment 1, the kind of diesel automobile is corresponding to the ⓒ as shown in FIG. 7

If a driver of the ⓒ diesel automobile drives its automobile in a state that the selection scale dial 67 is set to the 90 scale, the voltage (or electric current) waveform generated from the injector 40 (or the electric current core sensor 40*a*) passes through the limiter circuit 42 and thereby a pulse begins to be generated. The value given by calculating the pulse generated from the limiter circuit 42 is multiplied by the fuel pressure transform constant due to the voltage generated from the fuel pressure sensor 41.

By repeating the above process, the accumulated voltage (or the electric current) pulse widths output from the injector 40 (or the electric current core sensor 40*a*) is 43.69 that is correspond to 90 scales set by the selection scale dial 67. When an operating mode is a voltage waveform mode, the quantity of injected fuel is expressed as the following equation: 90×5.295 L=477 L by using the average fuel pressure transform constant 2.06 at the fuel quantity displaying part 61. When an operating mode is an electric current waveform mode, the quantity of injected fuel is expressed as the following equation: 90×7.5 L=675 L by using the average fuel pressure transform constant 2.06 at the fuel quantity displaying part 61. When the engine consumes the quantity of fuel oil 47.7 L that is 1/10 of 477 L, the lamp displaying part 62 having 10 graphic lamps is turned-on one by one. When the engine consumes the quantity of fuel oil 477 L, all of the lamp displaying part 62 is turned-on. This signal corresponding to information for exchanging of the engine oil is transmitted to other constitutional parts.

EMBODIMENT 2

Output of the Average Fuel Pressure Sensor is Variable

In the embodiment 2, the average output voltage of the fuel pressure sensor 41 is different in accordance with the kind of diesel automobile.

If a driver of the ⓕ diesel automobile as shown in Table 7 drives its automobile in a state that the selection scale dial 67 is set to 120 scale, the MPU 46 judges whether the quantity of injected fuel becomes 635 L (900 L) as shown in Tables 3 or 5 or not. If the engine consumes the quantity of injected fuel 635 L, the MPU 46 gives information relative to the exchange period for the engine oil to the driver.

If the driver urgently starts his or her automobile and then the output voltage of the average fuel pressure sensor is increased at 4V, the fuel pressure transform constant becomes 2.23 and the accumulated pulse widths becomes 53.8 hr(120 scale÷2.23).

If a driver drives his automobile in a state that the selection scale dial 67 is set to 120 scale, the voltage (or the electric current) waveform output from the injector 40 passes through the limiter circuit 42 as described above and thereby a pulse may be generated. At the MPU 46, the pulse calculated is multiplied by the fuel pressure transform constant due to the voltage output from the fuel pressure sensor 41.

At this time, since the accumulated time given by multiplying the fuel pressure transform constant corresponding to 120 scale is already set, the lamp displaying part 62 having 10 graphic lamps is turned-on one by one until the accumulated time becomes 12 (pulse width time×the fuel pressure transform constant) that is 1/10 of 120 scale. Since the quantity of injected fuel is consumed about 635 L so as to turn-on 10 lamps, which is corresponding to 120 scale, it is preferable to exchange the engine oil. This signal corresponding to information for exchanging of the engine oil is transmitted to other constitutional parts.

EMBODIMENT 3

Quantity of Injected Fuel Per Pulse Width Unit Time of the Injector 40 is Variable In the embodiment 3, the quantity of injected fuel per unit time is different in accordance with the kind of diesel automobile.

Referring to Table 1, the fuel quantity per pulse width time during operation at idle speeds of 800 rpm is 5.295 L. If an automobile consumes fuel oil of 6.00 L per pulse width time, the exchange period for the engine oil may be set a state that a driver drives his or her automobile by a short distance of 5,000 km with consuming fuel of 480 L. This is corresponding to the 80 scale (480 L+6 L/hr).

If a driver drives his or her automobile in a state that the selection scale dial 67 is set to the 80 scale, the voltage (or the electric current) waveform output from the injector 40 passes through the limiter circuit 42 as described above and thereby a pulse may be generated. At the MPU 46, the pulse calculated is multiplied by the fuel pressure transform constant due to the voltage output from the fuel pressure sensor 41.

At this time, since the accumulated time given by multiplying the fuel pressure transform constant corresponding to 80 scale is already set, the lamp displaying part 62 having 10 graphic lamps is turned-on one by one until the accumulated time becomes 8 (pulse width time×the fuel pressure transform constant) that is 1/10 of the 80 scale. Since the quantity of fuel oil 480 L required to turn-on 10 lamps, which is 80 scale, it is preferable to exchange the engine oil. This signal corresponding to information for exchanging of the engine oil is transmitted to other constitutional parts.

EMBODIMENT 4

Selection Scales are given by Performing a Test Drive

The above embodiments 1 to 3 may be proceed with ascertaining selection scales in accordance with the kind of diesel automobile, but the embodiment 4 may be proceed without ascertaining a proper selection scale for a diesel engine.

In other words, if a driver cannot know about information such as the quantity of injected fuel per purse width, the selection scale dial 67 corresponding to the test drive scale as shown in Table 3 is set as "1" and then the driver drives his or her car under severe operating condition.

When the traveling distance is 62.5 km under the state that all of graphic lamps 62*a*~62*j* of the lamp displaying part 62 are turned-on, the selection scales dial 67 is set to 80 scale(5,000 km÷62.5 km=80). When the driver drives his or her automobile under severe operating condition, the engine oil may be changed after driving the automobile by a distance of 5,000 km. When the driver drives his or her automobile under high speed driving condition, the engine oil may be changed after driving the automobile by a distance of 8,000~9,000 km.

Accordingly, it is possible to find out the proper selection scale in accordance with the kind of automobile by utilizing the test drive selection scale.

Hereinafter, an operational process of the gasoline engine fuel-computing program will be explained in detail.

If the MPU 46 does not receive any signal from the fuel pressure sensor 41, it judges whether the automobile's engine is gasoline engine or not. If the automobile's engine is gasoline engine, the MPU 46 performs the gasoline engine fuel-computing program.

FIG. 11 A shows a fuel injection waveform that is generated from the ECU 10 installed at the automobile and is applied to the injector 40 during operation at idle speeds in the gasoline engine. Referring to FIG. 11A, a section length between (TI) and (T2) is corresponding to a fuel injection time (Ti). The peak shaped waveform illustrates that the fuel injection waveform is highly increased due to the reverse electromotive force of the injector 40. The fuel injection time (Ti) may be changed in accordance with the engine revolution speed and so on.

If an electric voltage having a waveform as shown in FIG. 11A is applied to the injector 40 from the ECU 10 so as to supply the gasoline engine with a fuel, the voltage current waveform is inputted into the limiter circuit 42 of the wave shaping circuit 47 as shown in FIG. 6 and thereby the amplitude of the voltage waveform is controlled below a desired level. The voltage waveform having limited amplitude is applied to the spherical waveform generating part 43. Consequently, a safety spherical waveform may be output as shown in FIG. 11 B during generation of the voltage waveform from the injector 40.

The safety spherical wave generated from the spherical wave generating part 43 is applied to the pulse generating part 44 and thereby a pulse is rapidly output during the output of the spherical wave as shown FIG. 11C. The MPU 46 computes the pulse so as to produce the pulse width time and calculates the total fuel quantity of the gasoline engine by using this pulse width accumulated time.

The process for measuring the pulse width time and computing the quantity of injected fuel by utilizing the fuel injection signal transmitted from the MPU 46 into the injector 40 and for informing the exchange period for the engine oil and information relative to the gasoline engine to the driver will be explained in detail with reference to the embodiments 5 and 6.

EMBODIMENT 5

This embodiment 5 is applied to an automobile named Avante which has a fuel quantity of 170 cc/mm injected from one injector per one minute.

As shown in FIG. 6, when the automobile is an Avante having an injection quantity of 170 cc/min injected from one injector installed therein, the total fuel quantity after automobile driving at a distance of 5,000 km is 454.5 L. At this time, since the injection-accumulated time per one injector is 11.3 hr, the selection scale dial 67 must be set as 110 scale.

If a driver drives his or her automobile in a state that the selection scale dial 67 is set as 110 scale, the injection signal output from the injector 40 passes through the limiter circuit 42 and thereby a pulse may be generated. When the accumulated time of this pulse becomes 11 hr(11.3 hr), the fuel quantity is 488.8 L (454.5 L) and thereby it is time to exchange the engine oil. The information relative to the exchange period for the engine oil may be given to the driver.

EMBODIMENT 6

This embodiment 6 is applied to an automobile named EF Sonata, which has a fuel quantity of 311 cc/mm injected from one injector per one minute.

As shown in FIG. 6, when the automobile is an EF Sonata having an injection quantity of 311 cc/min injected from one injector installed therein, the total fuel quantity after automobile driving at a distance of 5,000 km is 769 L. At this time, since the injection-accumulated time per one injector is 10.3 hr, the selection scale dial 67 must be set as 100 scale.

If a driver drives his or her automobile in a state that the selection scale dial 67 is set as 100 scale, the injection signal output from the injector 40 passes through the limiter circuit 42 and thereby a pulse may be generated. When the accumulated time of this pulse becomes 10 hr(10.3 hr), the fuel quantity is 769and thereby it is time to change the engine oil.

The information relative to the exchange period for the engine oil may be given to the driver.

Hereinafter, the process of informing the exchange period for the engine oil in a state that the accumulated fuel quantities reach to a predetermined level will be explained with reference to FIGS. 12A and 12B in detail. Also, the process of informing the exchange period for various lubricating oils and constitutional parts on a basis of the exchange periods will be explained with reference to FIGS. 12A and 12B in detail. These processes will be explained with reference to the first to the fourth embodiments of which a diesel engine is applied and the fifth and the sixth embodiments of which a gasoline engine is applied.

As illustrated in FIG. 12, the MPU 46 continuously computes and reads on the quantity of injected fuel by accumulating the output waveform from the injector 40, which is corresponding to the signal of fuel injection. Then, the MPU 46 makes the lamps 62*a*~62*j* of the lamp displaying part 62 to be turned-on in proportion to the quantity of injected fuel (=steps 201). The MPU 46 judges whether the quantity of injected fuel is corresponding to the exchange period for the engine oil, which is set by operating the selection scale dial 67, or not (=steps 202). If the quantity of injected fuel is corresponding to the exchange period for the engine oil, the MPU 46 makes the speaker 64 transmit an alarm sound through the speaker 64 and makes the exchange parts displaying portion 63 display the phrase "engine oil replacement" (=steps 203). The MPU 46 computes the number of replacement to the engine oil (=steps 204) and judges the exchange period for the engine oil (=L8).

The driver may perceive the phrase "engine oil replacement" displayed by the exchange parts displaying portion 63 and the alarm sound generated form the speaker 64 in the process for judging the exchange period for the engine oil (=L8). The driver makes the drain bolt 91 installed at an engine oil fan 90 to be separated so as to exchange the engine oil and thereby waste engine oil is exhausted to the outside. The groove-shaped washer 92 engaged with the drain bolt 91 is separated from the engine oil fan 90 and is engaged therewith. Thereby, the change of on-off contact in the drain switch 45 may be sensed. When the MPU 46 judges the fact that there is a contact change at the reset button 48 (=steps 205), the MPU 46 perceives the fact that the replacement to the engine oil has been completed (=steps 206). The MPU 46 makes all of the lamps 62*a*~62*j* of the lamp displaying part 62 to be turned-off. That is, the MPU 46 performs the initialize process (L9).

By repeatedly completing the judges of the exchange period for the engine oil (=L8) and the performance of the initialize process (L9), the exchange period for the engine oil is continuously counted. The part table of the replacement objects stored in the MPU 46 as shown in FIG. 6 is read on in accordance with the number of replacement.

As illustrated in FIG. 12B, the MPU 46 judges the exchange period for various lubricating oils and constitutional parts such as an ignition plug, a cooling water, a mission oil and so on (=L10). When the exchange period for various oils and the constitutional parts has become, the MPU 46 makes the parts to be displayed by the exchange parts displaying portion 63 and performs the replacement parts alarming process (L11) for transmitting the alarm sound through the speaker 64.

After completing the replacement parts alarming process (L11), the MPU 46 senses the on/off contact state of the drain switch 45. Alternatively, the MPU 46 judges whether the contact of the reset button 48 is exchanged or not (=contact change judging step L12). If the contact change of the drain switch 45 or the reset button 48 is sensed, the MPU 46 makes the lamps 62*a*~62*j* of the lamp displaying part 62 to be turned-off and initializes the exchange period for various oils (=L13).

In the meantime, all of information such as the accumulated quantity of injected fuel, the number of exchanging for the engine oil, the alarm signal for informing the necessity for the exchange of engine oil, and the parts exchanging alarm signal, etc. are transmitted to a portable phone, PDA, which are an external terminal, by using a data transmission jack 51 and can be displayed thereon. If the apparatus according to the present invention is installed in a navigation device and a trip computer, the precision is highly enhanced. In the apparatus according to the present invention, information can be displayed at graphic type and various buttons may be employed at the touch screen system. Preferably, the navigation device or the trip computer may be employed in a new car.

Furthermore, the reset button 66 makes the drain bolt 91 installed at the engine oil fan 90 to be released there from so as to discharge the waste engine oil during exchange of the engine oil. If the drain switch 45 gets lost its function due to damage of the washer 92, the reset button 66 can be used as an urgent button.

When a user operates the reset button 66, the MPU 46 computes the exchange period for the engine oil. The requirement to operating the reset button 66 is allowed at the time that the engine oil is exchanged. If the user operates the reset button 66 at another time, the MPU 46 judges this operation as an error.

The up/down button 68 makes the user perceive the exchange period for the parts besides the engine oil. When a user operates the up/down button 68, the MPU 46 perceives this operation and makes the name of part to be displayed by the exchange parts displaying portion 63 at sequence. The MPU 46 makes the lamp displaying part 62 to be turned-on so as to allow the driver for perceiving the exchange period for the parts.

The present invention can be applied to the an electronically controlled fuel injection system, a gasoline engine, an electronically controlled fuel injection liquefied gas motor, and all of vehicles employing an electronically controlled fuel injection system.

As described above, the present invention can completely calculate the quantity of fuel by using a fuel injection signal that is applied to a motor vehicle and can inform the exchange period for the engine oil to a driver. Accordingly, there is no necessity for exchanging the engine oil only after automobile driving at a distance of 5,000 km. When a driver drives an automobile under severe operating condition, he or she can exchange the engine oil after automobile driving at a distance of 4,000~5,000 km. Alternatively, when a driver drives an automobile under comfortable operating condition such as a highway, he or she can exchange the engine oil after automobile driving at a distance of 8,000~9,000 km. Consequently, it is possible to prevent the engine oil from being excessively wasted and thereby the present invention gives a considerable reduction in costs.

Furthermore, it is possible to inform the exchange period for the engine oil and to inform the exchange period for various lubricating oils and constitutional parts in accordance with the exchange period for the engine oil to the driver through a displaying part. Due to this, it is possible to exchange various lubricating oils and constitutional parts on a basis of correct information. Accordingly, the driver may not be in a confusion of mind and various lubricating oils and constitutional parts can be exchanged under a proper condition. As a result, the automobile can have a long life and the safety for the diesel engine can be secured. Further, it is possible to reduce the quantity of fuel to 10~15%. In addition, it is possible to prevent air pollution.

According to the present invention, the driver can perceive a favorable time for discarding his or her used automobile on a basis of the total quantity of injected fuel.

While the present invention has been shown and described with reference to a particular embodiment thereof, it will be understood by those skilled in the art that various changes in form and detail may be effected therein without departing from the spirit and scope of the invention as defined by the appended claims.

What is claimed is:

1. A method for computing the quantity of injected fuel for an automobile engine equipped with an electronically controlled fuel injection system, the comprising the steps of:

computing (step 101) a voltage(electric current) pulse width time per minute during operation at idle speeds of 800 rpm by using a voltage(electric current) pulse width applied to an injector in two crank shaft revolution during operation at idle speeds of 800 rpm in a diesel engine;

computing (step 102) a quantity of injected fuel per the voltage(electric current) pulse width time during operation at idle speeds of 800 rpm by using the voltage (electric current) pulse width time per minute during operation at idle speeds of 800 rpm, which is given by the step 101 and by using the total quantity of injected fuel per minute during operation at idle speeds of 800 rpm;

computing (step 103) a fuel pressure transform constant by extracting the square root of a fuel pressure in the injector, which is corresponding to an output voltage of a fuel pressure sensor;

computing (step 104) a selection scale by calculating the fuel pressure transform constant given by the step 103 and an accumulated voltage(electric current) pulse width time; and computing (step 105) the total quantity of injected fuel for the diesel engine by using the selection scale given by the step 104 and the quantity of injected fuel per the voltage (electric current) pulse width time during operation at idle speeds of 800 rpm.

2. A method for computing the quantity of injected fuel for an automobile engine equipped with an electronically controlled fuel injection system, the comprising the steps of:

computing (step 301) the total quantity of injected fuel for a gasoline engine after driving the automobile by a distance of 5,000 km by using a quantity of fuel injected from one injector per one minute in the gasoline engine and by using a fuel efficiency of the automobile;

computing (step 302) an accumulated fuel injection time per one injector after driving the automobile by a distance of 5,000 km by using the total quantity of injected fuel for the gasoline engine after driving the automobile by a distance of 5,000 km, which is given by the step 301, and by using a quantity of fuel injected from one injector per one minute and by using the number of cylinders in the gasoline engine;

computing (step 303) a selection scale by multiplying the accumulated fuel injection time per one injector, which is given by the step 302, with ten times; and computing (step 304) the total quantity of injected fuel for the gasoline engine by using the accumulated fuel injection time per one injector, which is given by the step 302, and by using the selection scale given by the step 303.

3. An apparatus for detecting an exchange period for lubricating oils and constitutional parts in an automobile engine equipped with an electronically controlled fuel injection system, in which the automobile engine includes an injector for injecting a fuel according to a control signal of an electronic control unit, the apparatus comprising:

a wave shaping circuit for shaping a fuel injection signal of the electronic control unit and then for outputting a pulse being connected to the injector;

a MPU for computing the pulse generated from the wave shaping circuit, for adding up and calculating a quantity of injected fuel, for informing an exchange period for an engine oil to a driver in accordance with the quantity of injected fuel, for informing an exchange period for lubricating oil and parts in proportion to the number of replacement for the engine oil;

a selection scale dial for setting the exchange period for the engine oil under severe operating conditions in accordance with the kind of automobile, the selection scale dial being connected to an input terminal of the MPU;

an up/down button for enabling the driver to ascertain the exchange period for various lubricating oils and parts by selectively setting the kinds of the various lubricating oils and the parts, the up/down button being connected to an input terminal of the MPU;

a display part including a fuel quantity displaying part for displaying the quantity of injected fuel in the automobile as a numeral value, a lamp displaying part for displaying the number of replacement for the engine oil as a lamp, an exchange part display portion for displaying the parts to be exchanged as a letter, and a speaker for alarming the exchange period for various oils and parts as a sound, the display part being connected to an output terminal of the MPU; and a drain switch for initializing the lamp displaying part by being separated from an engine oil fan and being contacted therewith during exchange of the engine oil, the drain switch being connected to the input terminal of the MPU.

4. The apparatus for detecting an exchange period for lubricating oils and constitutional parts in an automobile engine equipped with an electronically controlled fuel injection system as claimed in claim 3, wherein a mode selecting part is connected to the input terminal of the MPU and includes a voltage selecting switch for enabling a user to select a voltage waveform generated from the injector and an electric current selecting switch for enabling the user to select an electric current waveform generated from an electric current core sensor.

5. The apparatus for detecting an exchange period for lubricating oils and constitutional parts in an automobile engine equipped with an electronically controlled fuel injection system as claimed in claim 3, wherein the drain switch is provided with a groove-shaped washer, in which a circumferential groove is formed along the circumference of the groove-shaped washer and a conductive wire is introduced and wound into the groove, wherein the groove-shaped washer is engaged with or released from the engine oil fan by means of a drain bolt.

* * * * *